US008951094B2

(12) United States Patent
Ropelewski

(10) Patent No.: US 8,951,094 B2
(45) Date of Patent: Feb. 10, 2015

(54) CONFETTI PROJECTOR

(71) Applicant: Joseph D. Ropelewski, Parma, OH (US)

(72) Inventor: Joseph D. Ropelewski, Parma, OH (US)

( * ) Notice: Subject to any disclaimer, the term of this patent is extended or adjusted under 35 U.S.C. 154(b) by 91 days.

(21) Appl. No.: 13/661,877

(22) Filed: Oct. 26, 2012

(65) Prior Publication Data

US 2013/0109274 A1 May 2, 2013

Related U.S. Application Data

(60) Provisional application No. 61/552,060, filed on Oct. 27, 2011.

(51) Int. Cl.
*A63H 37/00* (2006.01)

(52) U.S. Cl.
USPC ..... 446/475; 446/483

(58) Field of Classification Search
USPC ..... 446/475, 483
See application file for complete search history.

(56) References Cited

U.S. PATENT DOCUMENTS 3,602,601 A * 8/1971 Zenger et al. ..... 401/190
5,015,211 A * 5/1991 Reveen ..... 446/475
5,149,290 A * 9/1992 Reveen ..... 446/475
5,571,948 A * 11/1996 Kaplan et al. ..... 73/31.05
5,803,471 A * 9/1998 DeMars et al. ..... 280/40
6,109,856 A * 8/2000 Mings ..... 414/490
6,364,737 B1 * 4/2002 Sterr et al. ..... 446/475
6,641,458 B1 * 11/2003 Nofsinger et al. ..... 446/475
2004/0050877 A1 * 3/2004 Ono ..... 222/399

OTHER PUBLICATIONS

Archangel Fireworks SCUBA Confetti System; http://www.youtube.com/watch?v=xrUU-rXqdsg, Oct. 7, 2010.
Artistry in Motion Mini Blaster; www.artistryinmotion.com/miniblaster;miniblaster.html, Dec. 8, 2006.
Continuous Flow Confetti Cannons; www.spfx.com/continuous_Flow_Confetti_Cannon.html, Feb. 25, 2012.
Confetti Equipment Rental; www.confettirental.com, Jan. 1, 2014.
Hurrican Electric Confetti Blower; www.x-streamers.com/shippingcart/electric-launchers/hurricane-confetti-blower/, Dec. 3, 2009.
Reloadable Cannons; www.confetticannondirect.com/store/index.php?main_page=index&cPath=11&zenid=rlhng9o3b42mn2h0335ik2ag0, Feb. 6, 2014.
Floormount Cannons—Confetti Cannons dot Com; www.confetticannons.com/floormount-cannons.html, Aug. 13, 2003.
Shot Max / Confetti Max; www.aclassactfx.com/shotmax.htm, Aug. 3, 2004.

* cited by examiner

*Primary Examiner* — Vishu K. Mendiratta
(74) *Attorney, Agent, or Firm* — Roger Emerson; Emerson Thomson Bennett, LLC.

(57) ABSTRACT

In one arrangement, a confetti projector may be operated using SCUBA quality gas. In another arrangement, a confetti projector may include a support frame having a storage surface that is used to support, and thus transport, one or more gas canisters.

13 Claims, 24 Drawing Sheets

CONFETTI PROJECTOR

I. BACKGROUND

A. Field of Invention

The present invention relates generally to methods and apparatuses related to confetti projectors.

B. Description of the Related Art

Devices for projecting lightweight materials, such as confetti, are well known. One example is provided in U.S. Pat. No. 6,364,737 titled LIGHTWEIGHT MATERIAL PROJECTION SYSTEM. Another example is provided in U.S. Pat. No. 6,641,458 titled CONFETTI BLASTER. Such devices are known by different names including material projection systems, confetti blasters and confetti projectors.

Various ways of controlling confetti projectors are known. It is known, for example, to provide a manually adjustable valve. The operator of the confetti projector simply adjusts the manually adjustable valve from a closed position to an open position allowing a compressed gas to flow from a gas canister and through a discharge tube in order to draw a vacuum that projects the confetti. The operator determines the degree of valve opening in order to control the performance of the confetti projector. It is also known to use controllers to operate a control valve to adjust the compressed gas flow. In one known arrangement, the same compressed gas that draws a vacuum is used to open the control valve. A pressure regulator may be used to reduce the pressure of the compressed gas to a pressure appropriate for the control valve.

While known projection devices generally work well for their intended purposes, they have limitations. One limitation is that they require a hazardous gas, carbon dioxide, to operate. Another limitation is that the gas canister is not easily transported with the projection device. They have other limitations as well.

What is needed is a confetti projector that overcomes the limitations with known projection devices.

II. SUMMARY

According to one embodiment of this invention, a confetti projector may comprise: a support frame; a plurality of wheels supported to the support frame; and, a housing that is supported to the support frame. The housing may comprise a hopper, a discharge portion and an opening. The hopper may communicate with the discharge portion and the opening may communicate with the discharge portion. At least one of the support frame and the housing may comprise a storage surface. The confetti projector may also comprise: a first discharge tube that is supported to the housing and communicates with the discharge portion of the hopper; a first gas canister that is supported on the storage surface; and, piping that comprises a first valve and that communicates the first gas canister to one of the housing and the first discharge tube. The confetti projector may be operable by opening the first valve a desired degree to permit gas to exit the first gas canister and enter the first discharge tube to draw a vacuum in the first discharge tube to cause associated ambient air to travel into the opening in the housing and then through the discharge portion to cause associated confetti within the hopper to exit the first discharge tube. The confetti projector may be transportable on the plurality of wheels to simultaneously transport the support frame, the housing, the first discharge tube, the first gas canister and the piping.

According to another embodiment of this invention, a method may comprise the steps of: (A) providing a confetti projector comprising: (1) a support frame; (2) a plurality of wheels supported to the support frame; (3) a housing that is supported to the support frame; wherein the housing comprises a hopper, a discharge portion and an opening; wherein the hopper communicates with the discharge portion and the opening communicates with the discharge portion; (4) wherein at least one of the support frame and the housing comprises a storage surface (5) a first discharge tube that is supported to the housing and communicates with the discharge portion of the hopper; (6) a first gas canister; and (7) piping that comprises a valve; (B) supporting the first gas canister on the storage surface; (C) transporting the confetti projector to a desired location by rolling the plurality of wheels on an associated ground surface to simultaneously transport the support frame, the housing, the first discharge tube, the first gas canister and the piping; (D) connecting the piping between the first gas canister and one of the housing and the first discharge tube; (E) placing confetti in the hopper; and, (F) operating the confetti projector by: opening the valve a desired degree to permit gas to exit the first gas canister and enter the first discharge tube to draw a vacuum in the first discharge tube to cause ambient air to travel into the opening in the housing and then through the discharge portion to cause the confetti within the hopper to exit the first discharge tube.

According to yet another embodiment of this invention, a confetti projector may comprise: a housing, having a hopper, a discharge portion and an opening, a first discharge tube that is supported to the housing and communicates with the discharge portion of the hopper; a gas canister that contains SCUBA quality gas; and, piping that comprises a valve and that communicates the gas canister to one of the housing and the discharge tube. The piping may have a use rating of at least 4000 PSI. The hopper may communicate with the discharge portion and the opening may communicate with the discharge portion. The confetti projector may be operable by opening the valve a desired degree to permit the SCUBA quality gas to exit the gas canister and enter the first discharge tube to draw a vacuum in the first discharge tube to cause associated ambient air to travel into the opening and then through the discharge portion to cause associated confetti within the hopper to exit the first discharge tube.

One advantage of this invention is that non-hazardous and environmentally friendly gas, such as the gas used with SCUBA gear, can be used to project confetti and the like.

Another advantage of this invention is that the gas canister can be easily transported along with the support frame.

Still other benefits and advantages of the invention will become apparent to those skilled in the art to which it pertains upon a reading and understanding of the following detailed specification.

III. BRIEF DESCRIPTION OF HE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
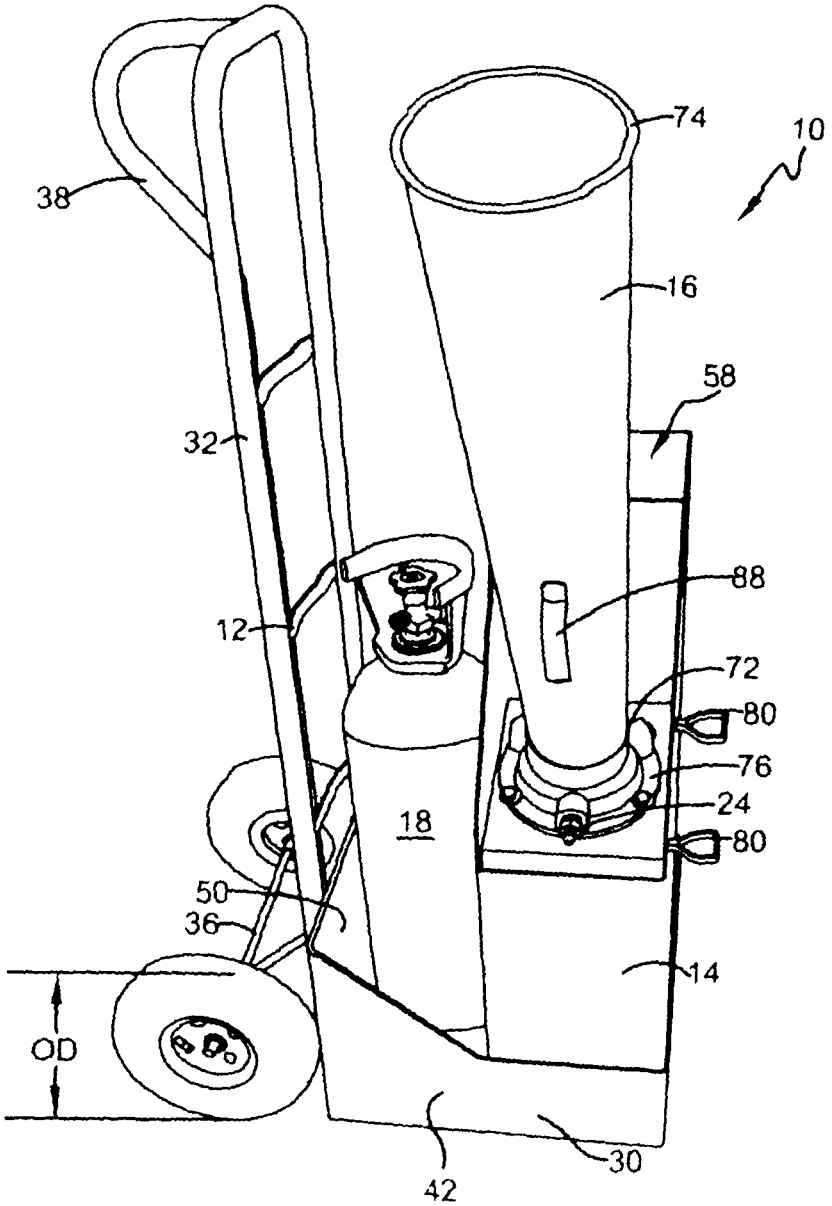
FIG. 1 is a right side perspective view of a confetti projector according to some embodiments of this invention, with piping removed.

Referring now to the drawings wherein the showings are for purposes of illustrating embodiments of the invention only and not for purposes of limiting the same, and wherein like reference numerals are understood to refer to like components, FIG. 1-5 show a confetti projector 10 according to some embodiments of this invention. The confetti projector 10 is used to project confetti and other lightweight materials into the air to create desirable visual effects as is well known to those of skill in the art. As used in this patent, the word "confetti" is used to include all lightweight materials suitable to be projected including streamers, glitters, plush balls, foam shapes, etc.

With reference now to FIGS. 1-6, the confetti projector 10 may include a support frame 12, a housing 14 mounted to the support frame 112, a discharge tube 16, a gas canister 18 and piping 20 that transfers gas from the gas canister 18 to the housing 14 and/or discharge tube 16. While the gas used with this invention may be of any type chosen with the sound judgment of a person of skill in the art, in one embodiment the gas is non-hazardous. In one specific embodiment, the gas is suitable for use with SCUBA (Self-Contained Underwater Breathing Apparatus) gear, such as compressed air. Thus this gas is considered SCUBA quality gas. Because the pressure of the gas used with SCUBA gear is typically greater than the gas used with known projection devices, the gas canister 18 and the piping 20 must be suitable for higher pressures. Known projection devices, for example, use carbon dioxide ($CO_2$) gas at pressures of around 1600 pounds per square inch (PSI). Thus, their gas canister and piping is typically rated at 1800 PSI or the like. SCUBA gear, however, is typically used at much higher pressures of around 4000 PSI. Thus, in one embodiment, the gas canister 18 and piping 20 of this invention have a use rating of at least 4000 PSI. In one specific embodiment, the gas canister 18 has a use rating of 4000 PSI. The piping 20 may include a hose 22, pipe fittings 24 and a valve 26. The hose 22 and fittings 24 may have a use rating of 4000 PSI and the valve 26 may have a use rating of 6000 PSI. When the confetti projector 10 is used with a SCUBA rated gas canister 18, a SCUBA fitting 28 may be used with the piping 20, as known to those of skill in the art.

With reference now to FIGS. 1-3 and 7-9, the support frame 12 may include a base 30 and a support structure 32 that may extend generally vertically upward from the base 30. A plurality of wheels 34 may be attached to the support frame 12 in any known manner. For the embodiment shown, two wheels 34 are used. In this way the confetti projector 10 can be easily transported in a manner similar to a dolly. This is an improvement over known projection devices that use four small castor wheels that are easily entangled in grassy or rocky terrain. The wheels 34 may have an outside diameter (OD), in one embodiment, of at least 5 inches. An axle 36 may interconnect the wheels and may be used to attach the wheels 34 to the support structure 32, as shown. In another embodiment, one or more axles may be used to connect the wheels 34 to the base 30. The support frame 12 may include a handle 38 for use by an operator when transporting the confetti projector 10 in a known manner.

With continuing reference to FIGS. 1-3 and 7-9, the base 30 may have a bottom surface 40, a pair of side walls 42, 42 and a back wall 44 that extend generally upward from the bottom surface 40. The front portion may comprise an opening 46 for purposes to be discussed below. A housing bracket 48, used to hold the housing 14 as will be discussed further below, may be attached near the front of the base 30 spaced upwardly from the bottom surface 40. The housing bracket 48, in one embodiment, does not extend all the way to the back wall 44. This provides a storage space 50 that is well suited to store at least one gas canister 18. For the embodiment shown, multiple gas canisters can be stored in the storage space 50. Of course other items, such as confetti could also be placed in the storage space 50. Such a storage space suitable for storing and transporting the gas canister is not provided with known projection devices. While the side walls 42, 42 and back wall 44 can be sized and shaped in any manner chosen with the sound judgment of a person of skill in the art, for the embodiment shown, the side walls 42, 42 include an angled portion 52 that connects the front portion of the side walls 42, 42 to the back wall 44. This better equips the storage space 50 to support the gas canister 18.

Figure 2:
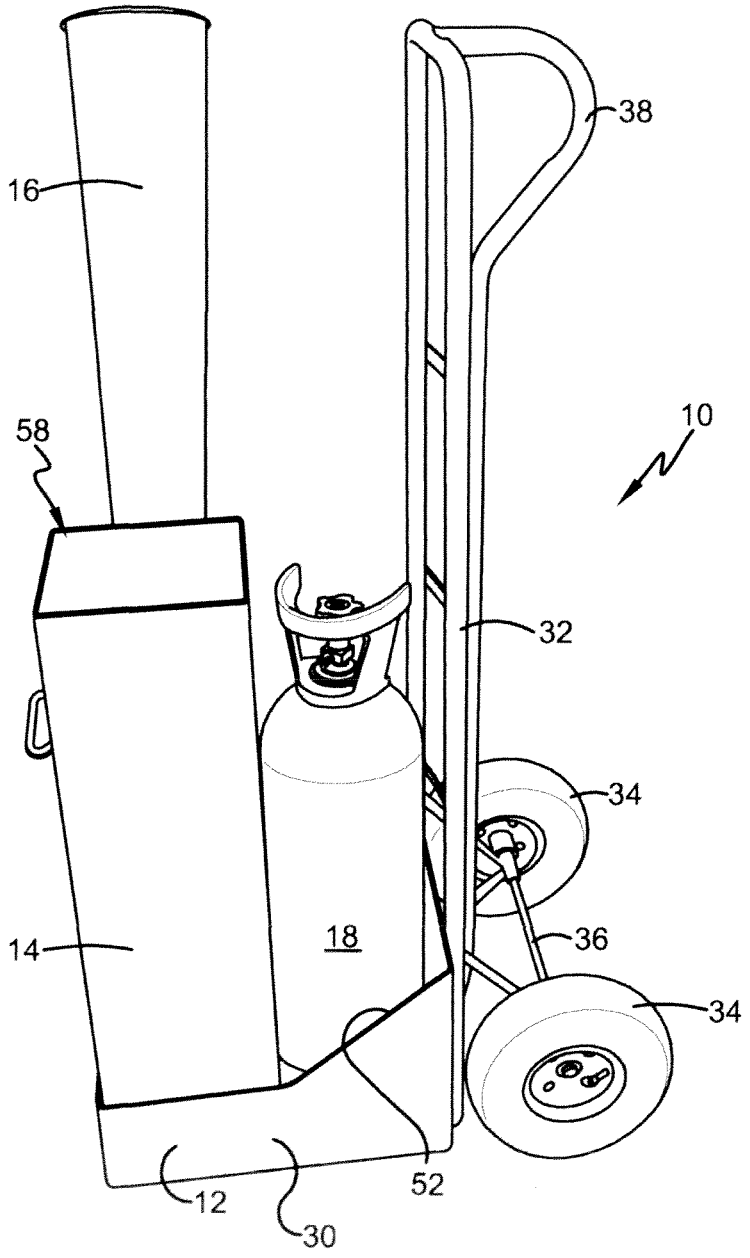
FIG. 2 is a left side perspective view of the confetti projector shown in FIG. 1.
Figure 3:
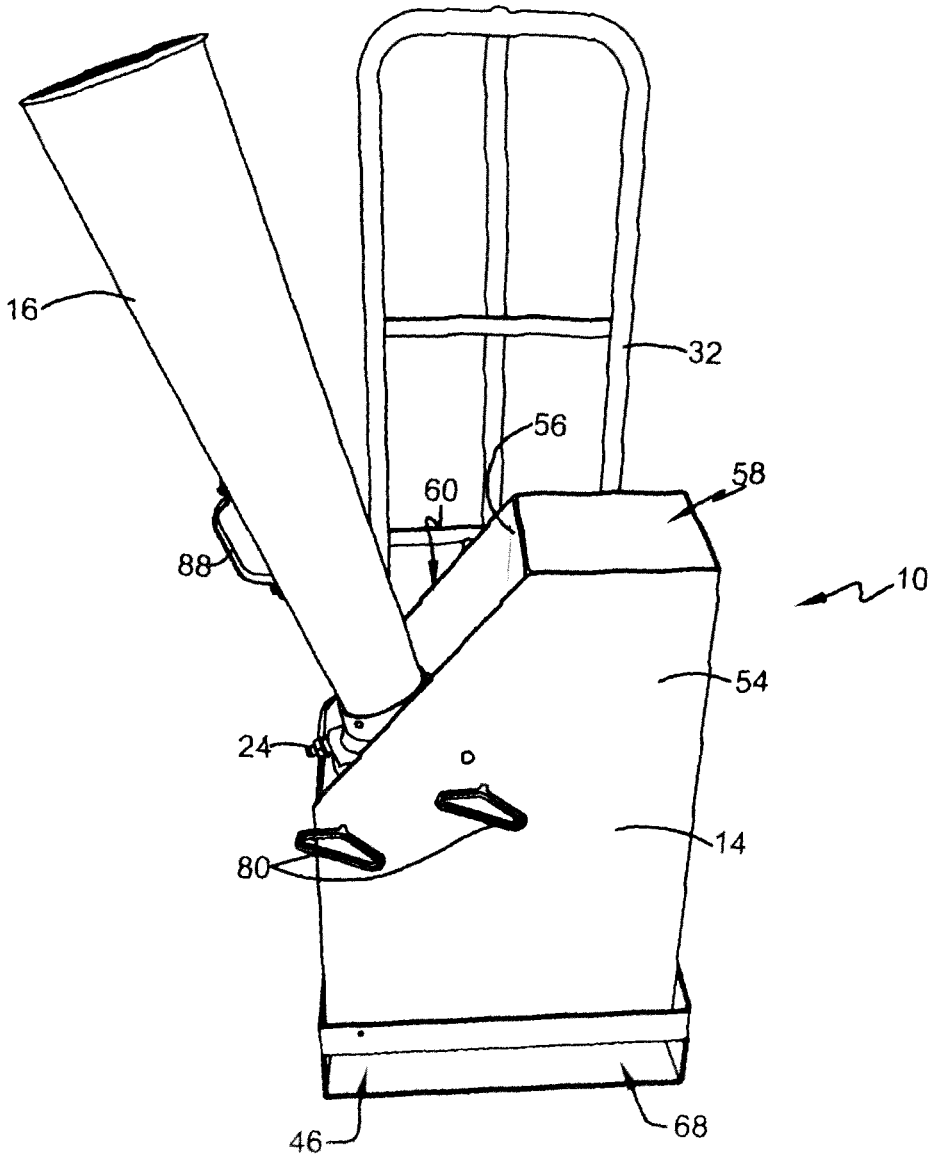
FIG. 3 is a front perspective view of the confetti projector shown in FIG. 1.
Figure 4:
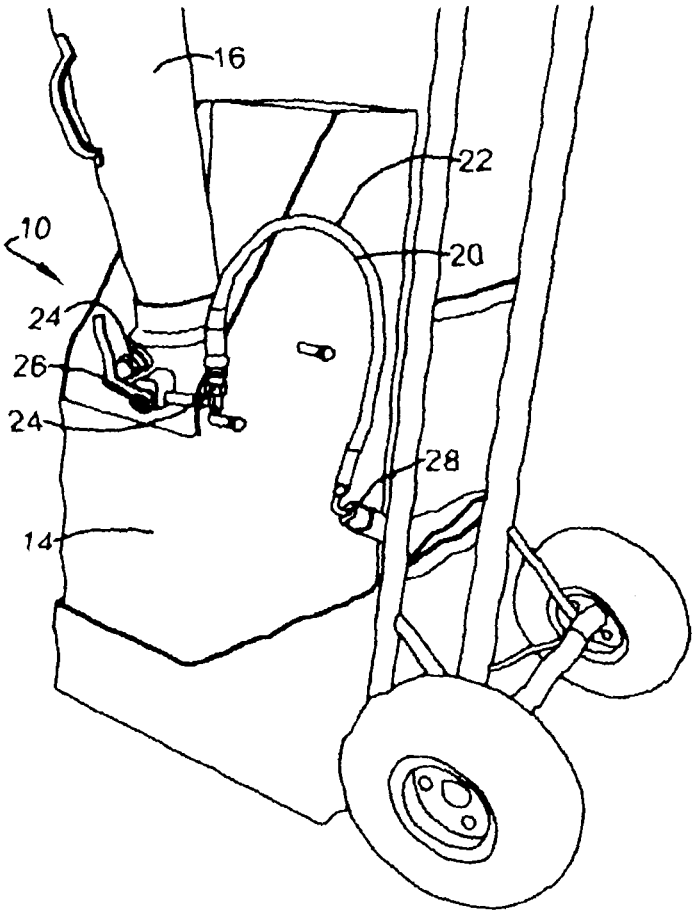
FIG. 4 is a perspective view of the confetti projector shown in FIG. 1 with the piping added and the gas canister removed.
Figure 5:
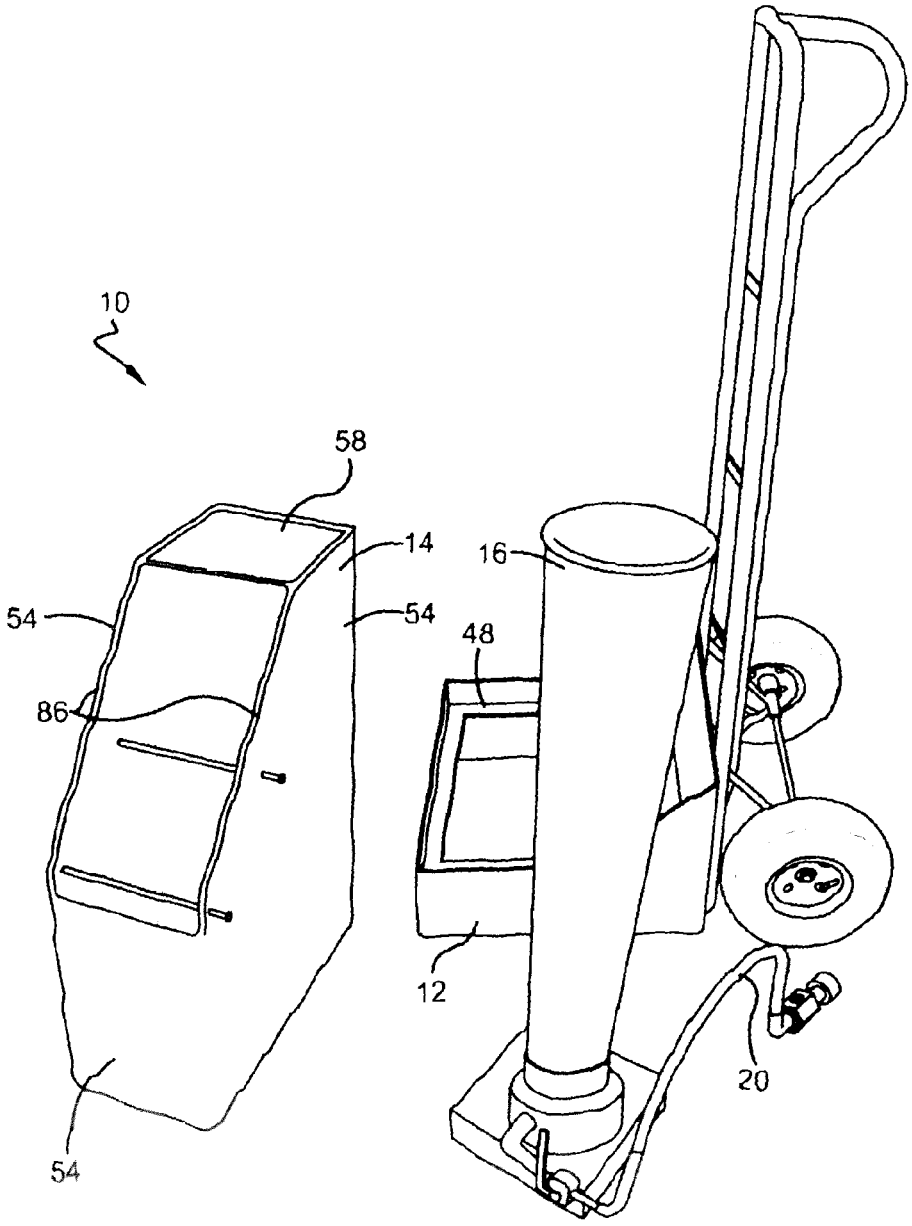
FIG. 5 is an assembly view of a confetti projector.
Figure 6:
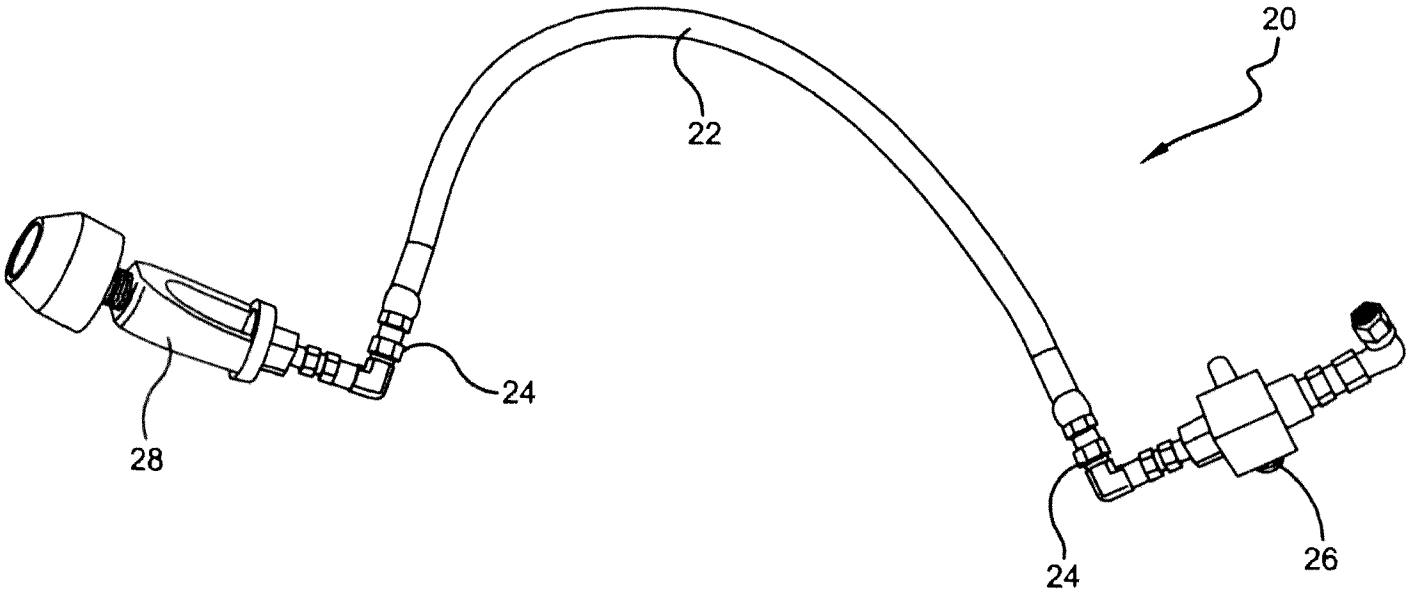
FIG. 6 is a perspective view of piping that may be used with a confetti projector of this invention.
Figure 7:
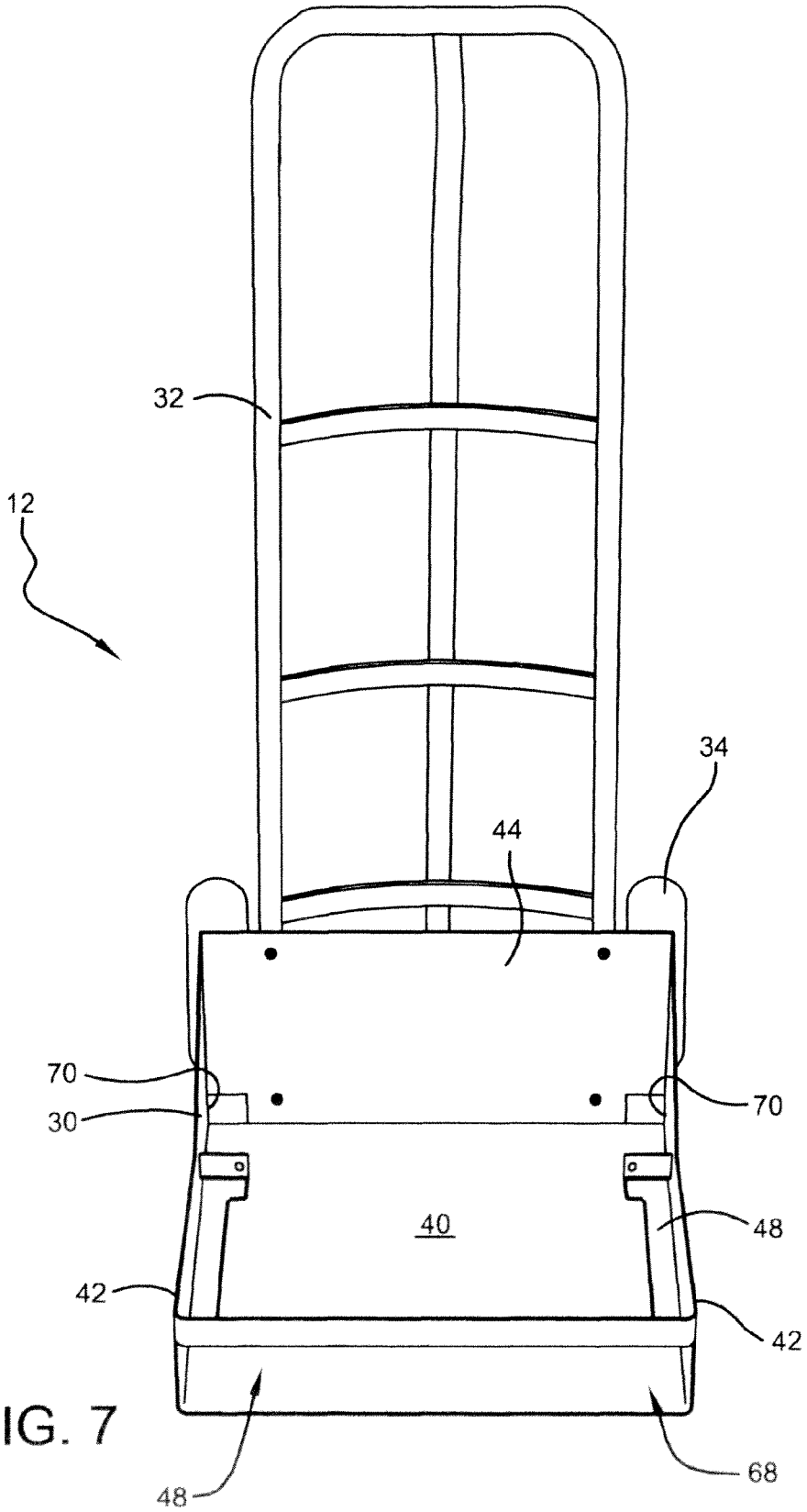
FIG. 7 is a front perspective view of the support frame.
Figure 8:
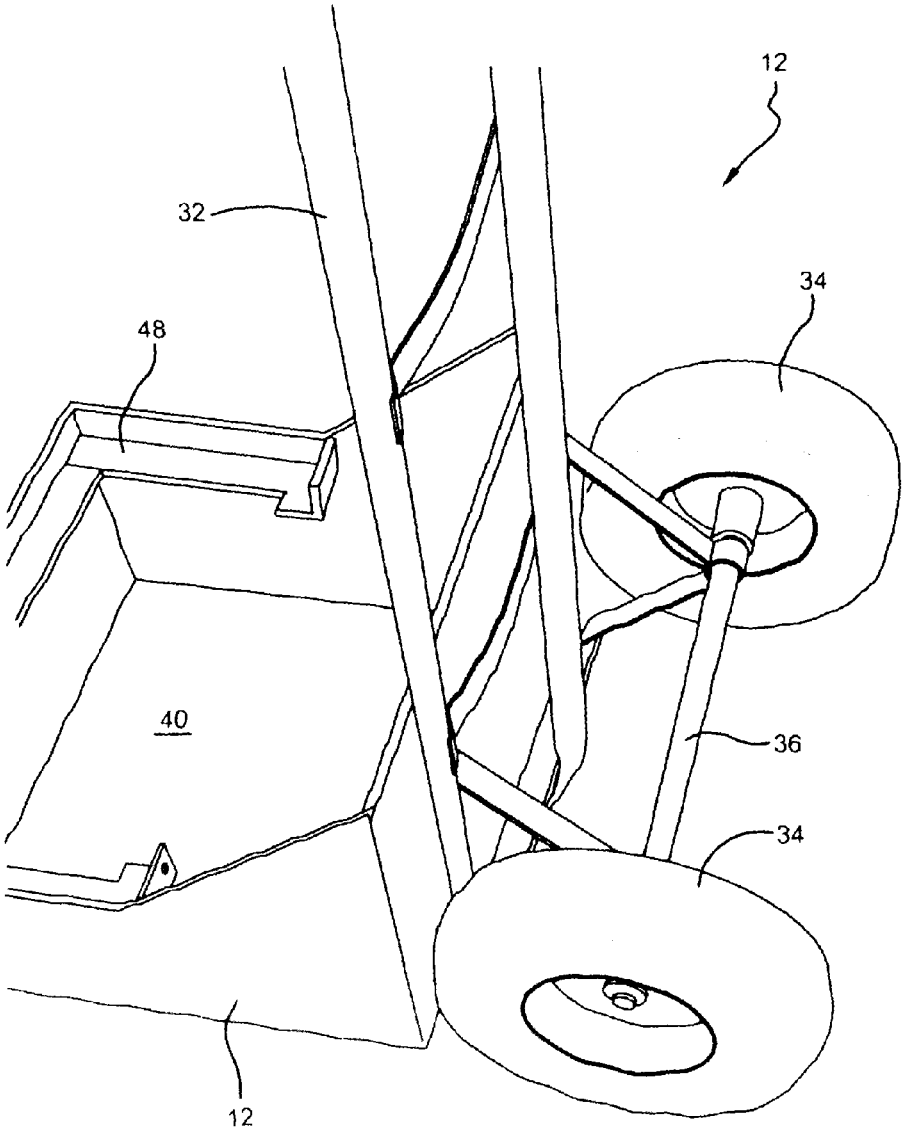
FIG. 8 is a left side perspective view of the support frame shown in FIG. 7.
Figure 9:
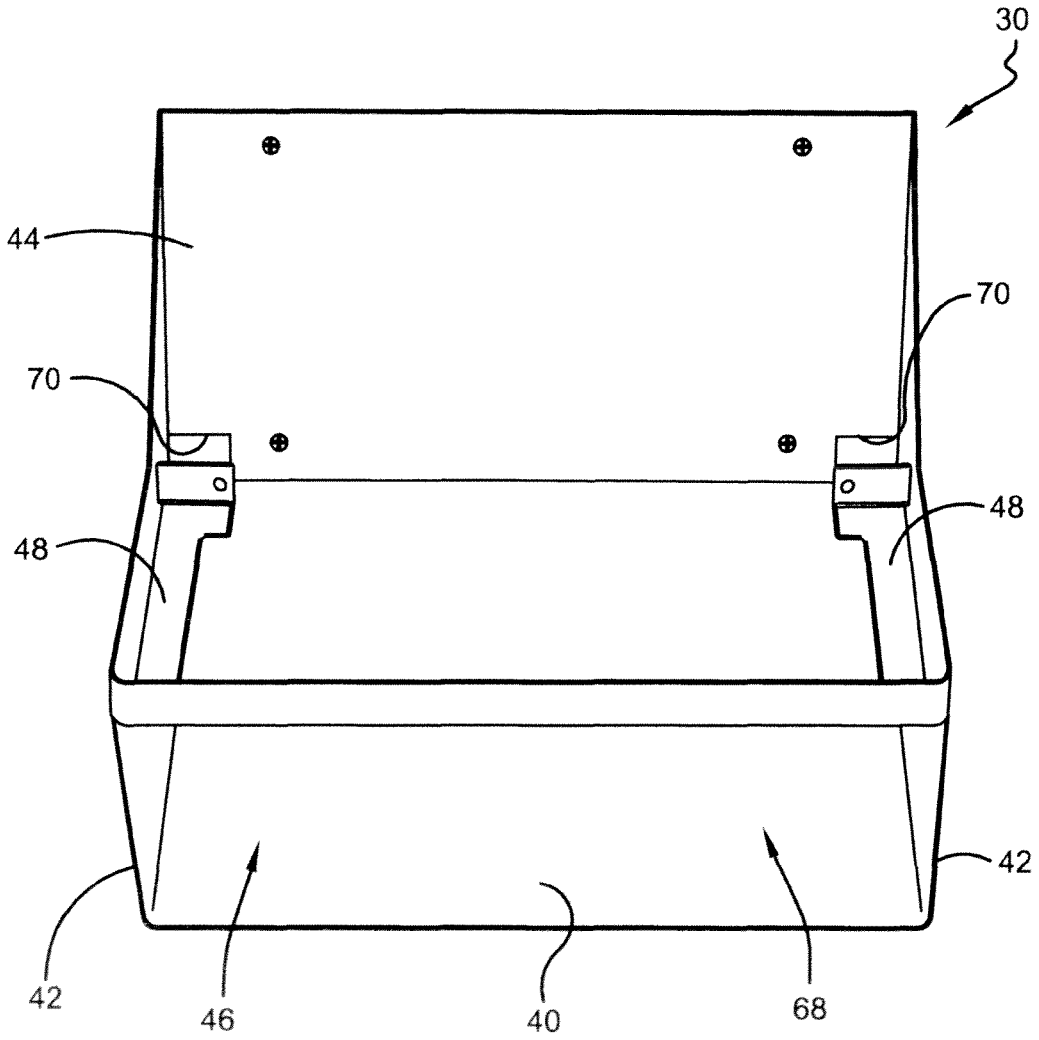
FIG. 9 is a close-up front perspective view of the support frame shown in FIG. 7.
Figure 10:
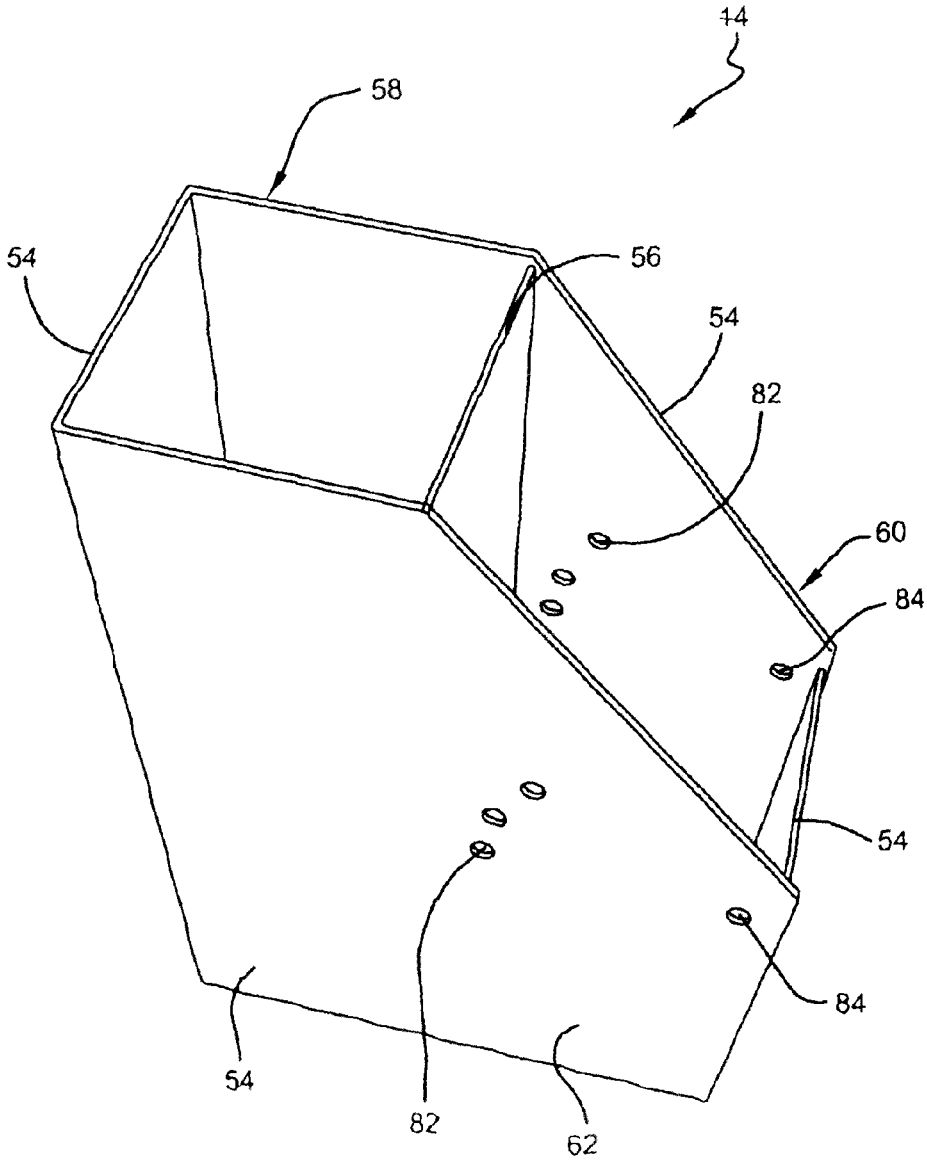
FIG. 10 is a perspective view of a housing.
Figure 11:
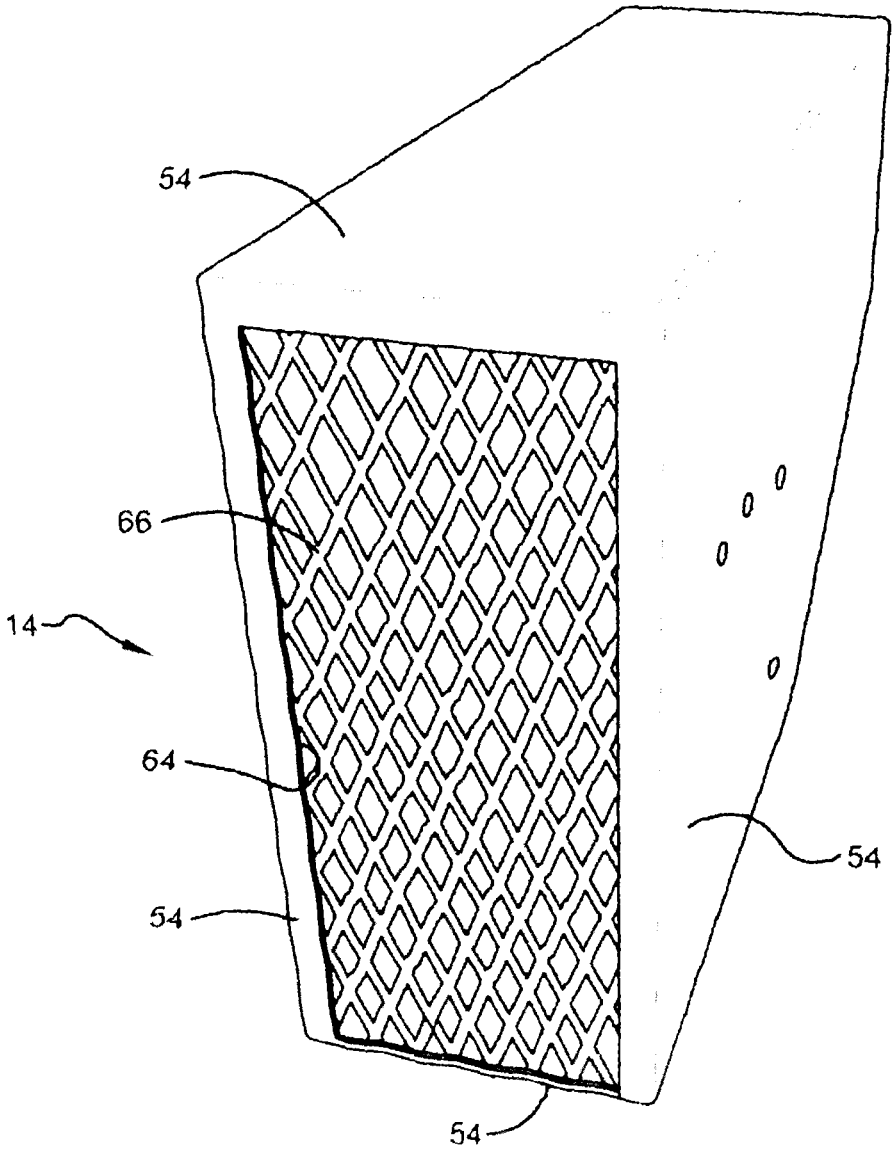
FIG. 11 is a perspective bottom view of the housing shown in FIG. 10.

With reference now to FIGS. 1-5 and 10-11, the housing 14 may be generally rectangular in cross-section having four outer walls 54 and an inner wall 56 that divides the housing 14 into a hopper 58 and a discharge portion 60. The inner wall 56 may not extend all the way down to the bottom 62 of the housing 14 thereby creating a space for confetti to travel down the hopper 58 and up into the discharge portion 60. The outer walls 54 of the discharge portion 60 may be angled 86 and sized, as shown, to better accommodate the discharge tube 16 as will be discussed below. The bottom 62 of the housing 14 may include an opening 64 that, in one embodiment, is covered by mesh 66. The opening 64 provides an ambient air inlet for the housing 14 as will be discussed further below. The bottom 62 of the housing 14 is supported on the housing bracket 48. Connectors such as bolts, not shown, can be used to secure the housing 14 to the housing bracket 48. The housing 14 can be easily switched from a "right hand" orientation (where the discharge tube 16 is on the right side of the confetti projector 10 from the position of an operator behind the confetti projector 10) as shown in FIGS. 1-3 to a "left hand" orientation (where the discharge tube 16 is on the left side of the confetti projector 10 from the position of an operator behind the confetti projector 10), not shown.

With reference now to FIGS. 3 and 7-9, with the housing 14 positioned on the housing bracket 48, it should be noted that the base 30 defines a plenum 68 that requires the ambient air to move horizontally along the bottom surface 40 before it moves vertically (upward) into the opening 64. Specifically, air moves into the opening 46 in the base 30, along the bottom surface 40 and then up through the opening 64 in the housing 14. Ambient air may also move from behind the housing 14, down to the base 30, horizontally along the bottom surface 40 and then vertically (upward) into the opening 64. For the embodiment shown, the back wall 44 of the base 30 may have one or more openings 70 that also permit ambient air to move horizontally along the bottom surface 40 before it moves vertically (upward) into the opening 64. By causing the ambient air to move horizontally and then vertically, the plenum 68 prevents, or at least greatly minimizes, unwanted materials such as grass clippings, small stones and the like from being drawn into the housing 14 and then through the discharge tube 16.

With reference now to FIGS. 1-5, the discharge tube 16 attaches to the housing 14 and is hollow so it can be used to discharge the confetti. While the discharge tube 16 may be of any size and shape chosen with the sound judgment of a person of skill in the art, the discharge tube 16 shown is frusto-conically shaped to use the venturi effect. The discharge tube 16 may have a handle 88 for use in adjusting the position of the discharge tube 16. A proximal end 72 of the discharge tube 16 attaches to the discharge portion 60 of the housing 14 and a distal end 74 is used to discharge the confetti away from the confetti projector 10. A tube bracket 76 is attached to the proximal end 72 of the discharge tube 16 in any suitable manner, such as by welding. The tube bracket 76 includes a pair of apertures 78, 78 that receive adjustment pins 80, 80 as will be discussed further below. One of the fittings 24 may be attached to the proximal end of the discharge tube 16. For the embodiment shown, the fitting 24 is attached to the tube bracket 76. The two opposite outer walls 54 of the housing 14 each have two sets of adjustment holes 82, 84 that are separated by the same distance as the apertures 78, 78 in the tube bracket 76. At least one set of holes (set 82 shown) includes multiple holes on an arc equidistant from a hole in the other set (set/hole 84 shown). This permits the discharge tube 16 to be adjusted to various angles as desired.

With reference now to FIGS. 1-11, the operation of the confetti projector 10 will now be described. The housing 14 may be positioned in either the right hand or left hand position, as desired. The desired gas canister 18 is filled with the appropriate gas and then positioned onto the bottom surface 40 of the base 30 within the storage space 50. The discharge tube 16 may be angled as desired by aligning the desired holes from the first and second set of holes 82, 84 with the apertures 78, 78. The adjustment pins 80 are then inserted into the holes 82, 84 and apertures 78, 78 to secure the discharge tube 16 to the housing 14 at the desired orientation. In one embodiment the adjustment pins 80 extend through the first and second sets of holes 82, 84 in both outer walls 54 of the housing 14. The piping 20 can then be attached at one end to the gas canister 18 and at the opposite end to the discharge tube 16. A desired amount of confetti can be placed into the hopper 58. The confetti projector 10 can then be rolled, using wheels 34, over many types of terrain to position the confetti projector 10 in the desired location. When it is desired to use the confetti projector 10, it is only necessary to open the valve 26 a desired amount. This will permit the gas to exit the gas canister 18 and enter the discharge tube 16. The escaping gas draws a vacuum causing ambient air to travel into the plenum 68 and causing the confetti to exit the discharge tube 16. The valve 26 can be opened and/or closed to adjust the delivery of confetti and, if desired, additional confetti can be added to the hopper 58. Once the gas canister 18 is emptied, it can be replaced and the operation can commence again as just described.

Figure 12:
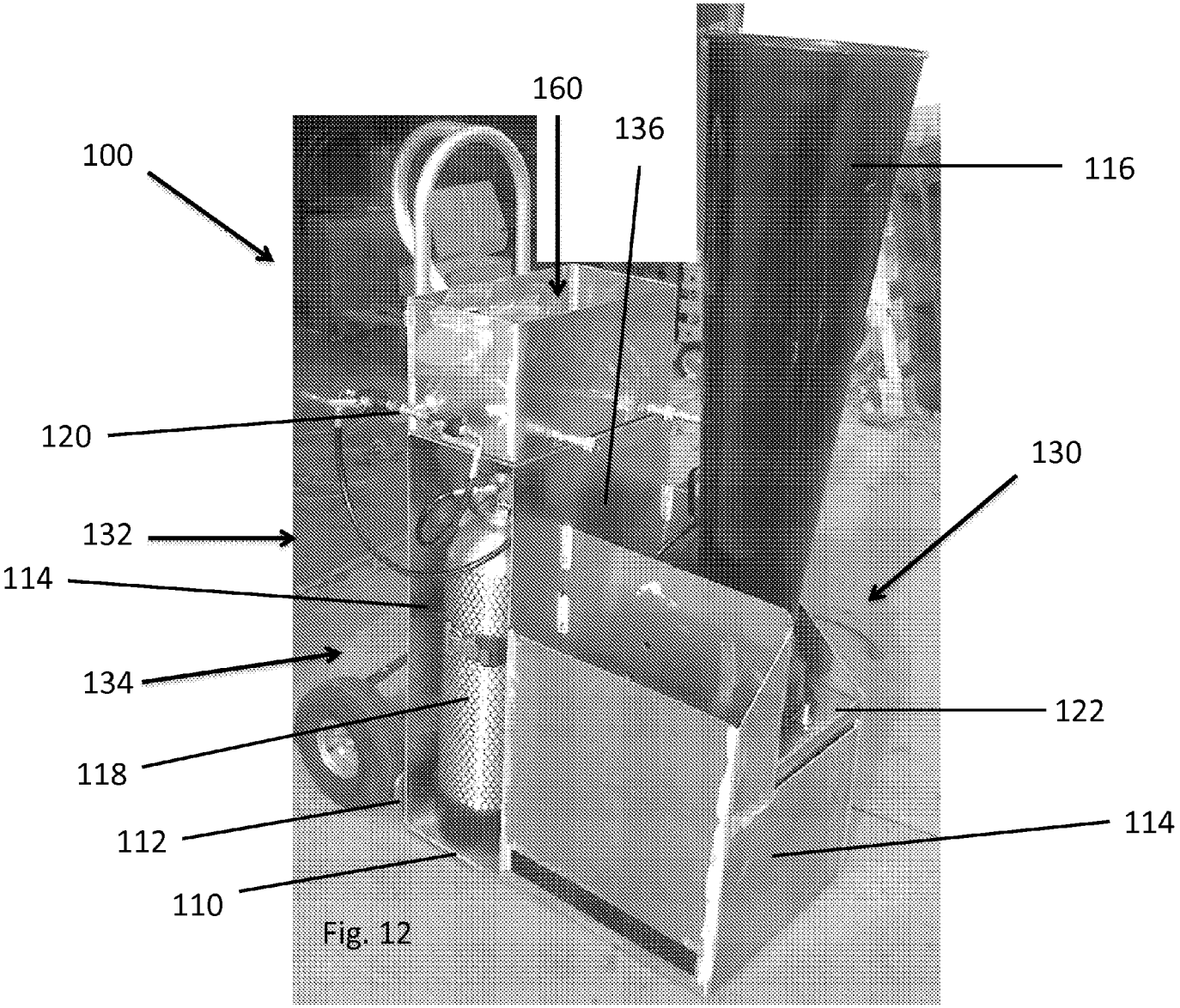
FIG. 12 is a perspective view of a confetti projector according to some embodiments of this invention.

FIG. 12 shows a confetti projector 100 according to other embodiments of this invention. The confetti projector 100, in some ways similar to the previously described confetti projector 10, may include a support frame 112, a housing 114 supported to the support frame 112, a discharge tube 116, one or more gas canisters 118 and piping 120 that transfers gas from the gas canister 118 to the housing 114 and/or discharge tube 116. The housing 114 may have a first section 130 to which the discharge tube 116 is attached and a second section 132 defining a storage space 134 that is well suited to store at least one gas canister 118. For the embodiment shown, multiple gas canisters can be stored in the storage space 134. The gas canisters may be supported on a storage surface 110 that is formed on at least one of the support frame 112 and the housing 114. For the embodiment shown, the storage surface 110 is formed on the housing 114. For the embodiment shown, a wall 136 separates the first and second sections 130, 132.

While the gas used with the confetti projector 100 may be of any type chosen with the sound judgment of a person of skill in the art, in one embodiment the gas is non-hazardous. In one specific embodiment, the gas is suitable for use with SCUBA (Self-Contained Underwater Breathing Apparatus) gear, such as compressed air. Thus this gas is considered SCUBA quality gas. Because the pressure of the gas used with SCUBA gear is typically greater than the gas used with known projection devices, the gas canister 118 and the piping 120 must be suitable for higher pressures. Known projection devices, for example, use carbon dioxide gas at pressures of around 1600 pounds per square inch (PSI). Thus, their gas canister and piping is typically rated at 1800 PSI or the like. SCUBA gear, however, is typically used at much higher pressures of around 4000 PSI. As the operation of the confetti projector 100 is in many ways similar to the operation of the previously described confetti projector 10, only significant differences will be emphasized.

Figure 14:
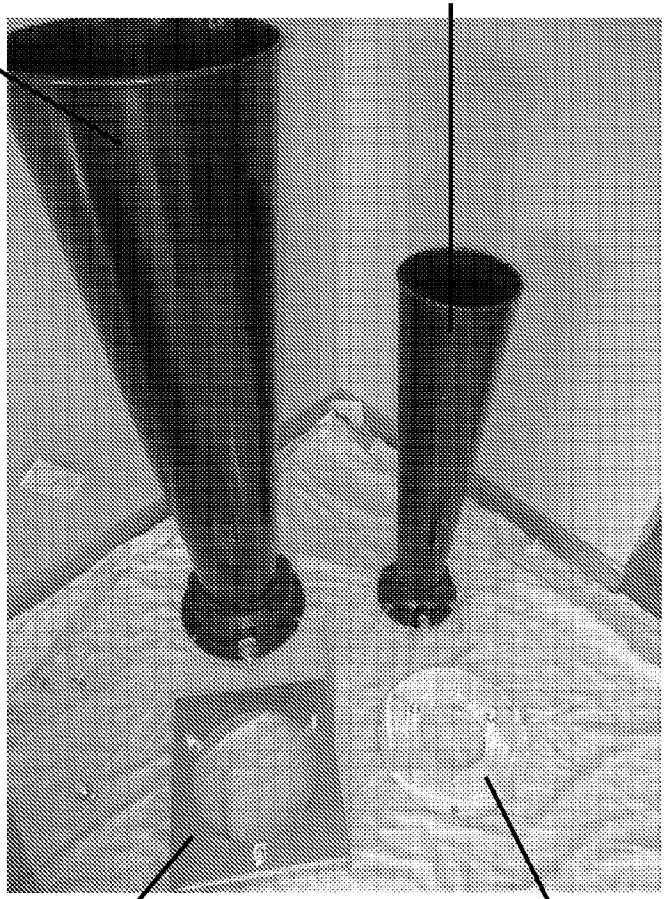
FIG. 14 is a perspective view showing two different sized discharge tubes, a tube bracket and an adapter plate.
Figure 13:
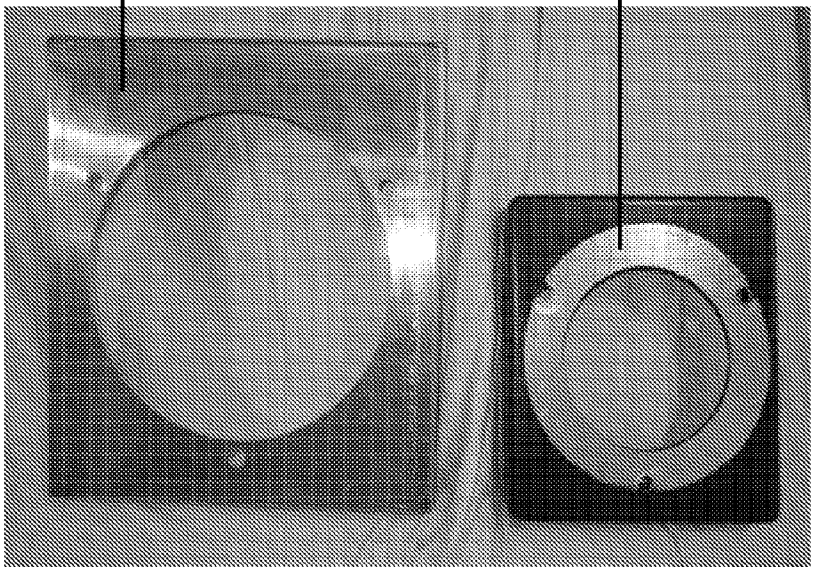
FIG. 13 is a top view of two different tube brackets.
Figure 16:
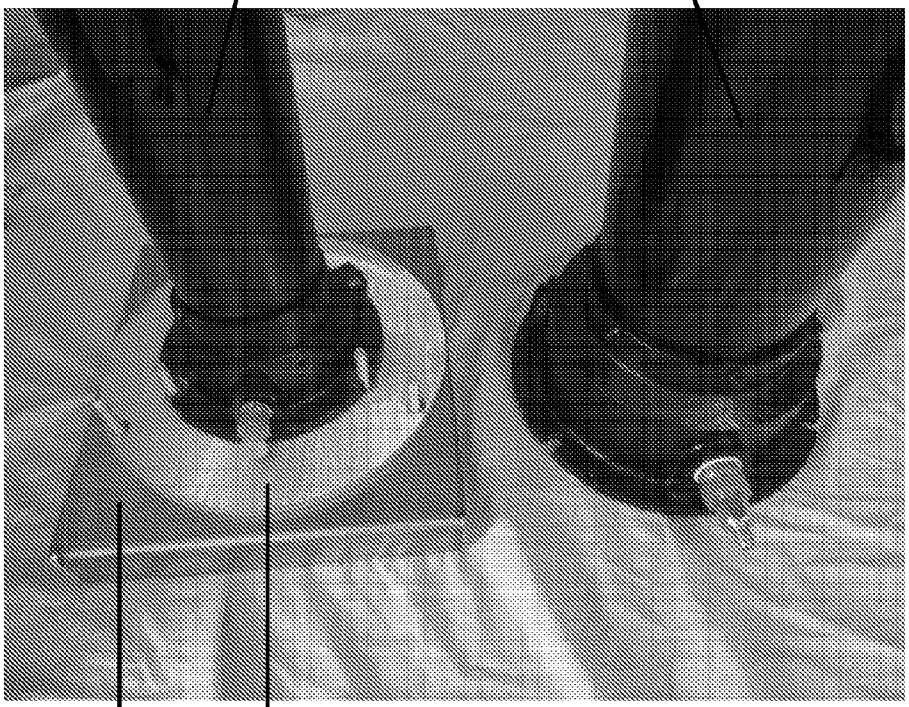
FIG. 16 is a top perspective view similar to that shown in FIG. 15 but showing the two different sized discharge tubes in another orientation with a matching tube bracket and adapter plate.
Figure 15:
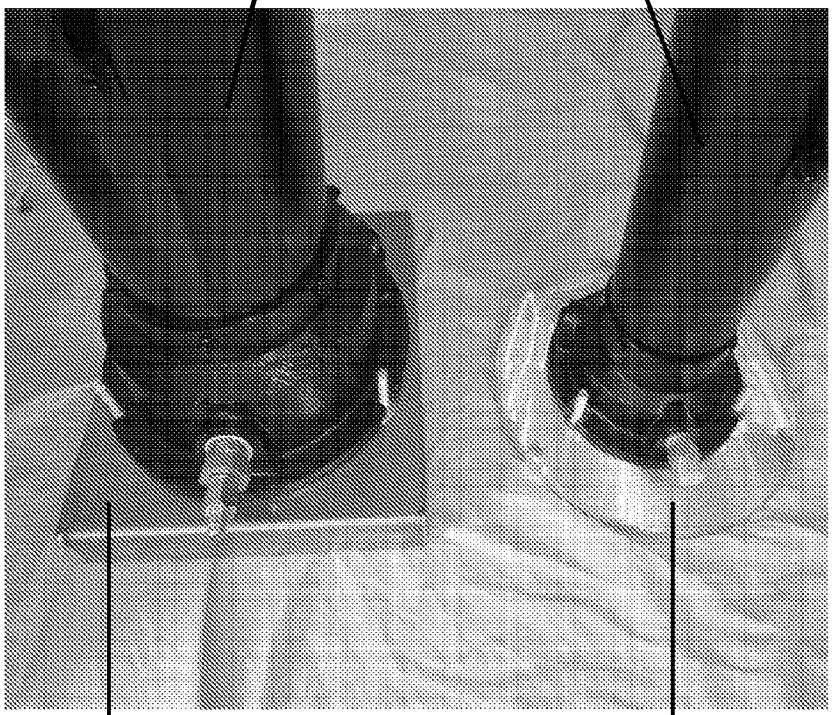
FIG. 15 is a top perspective view showing the two different sized discharge tubes in one orientation with a matching tube bracket and adapter plate.

FIG. 13 shows the tube bracket 76 that is referenced above and used with the confetti projector 10 positioned next to a tube bracket 122 used with the confetti projector 100. The tube bracket 76 is designed to fit only one size of discharge tube 16 (referenced above) and shown in FIG. 14). FIGS. 12 and 14 illustrate how the tube bracket 122 is sized to fit the relatively larger discharge tube 116. However, if adapter plate 124, which may have a generally ring shape as shown, is attached to the tube bracket 122, it can then fit to the relatively smaller discharge tube 16. This modular design provides options for using the confetti projector 100 at different events/productions by permitting the use of either discharge tube 16 or discharge tube 116 or using both, one after the other. FIG. 15 shows the relatively larger discharge tube 116 mounted to the tube bracket 122 and the relatively smaller discharge tube 16 mounted to the adapter plate 124. In FIG. 16, the discharge tubes are reversed; the relatively smaller discharge tube 16, with adapter plate 124, is mounted to the tube bracket 122 while the relatively larger discharge tube 116 is shown in a non-use condition.

Figure 17:
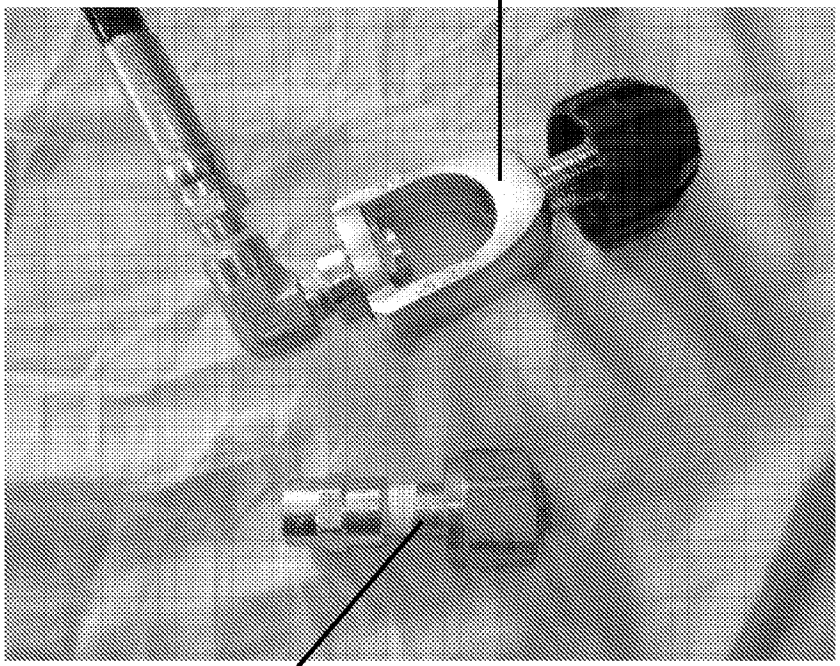
FIG. 17 is a top view comparing a SCUBA fitting with a $CO_2$ fitting.

FIG. 17 shows the SCUBA fitting 28 used to attach to a SCUBA tank (or canister) and a $CO_2$ fitting 102, which is typically used with $CO_2$ tanks. The SCUBA fitting 28, commonly referred to as a yoke, is rated for 4000 psi to cover SCUBA tanks filled to about 3300 psi and thus operates with SCUBA quality gas. The $CO_2$ fitting 102, however, is for tanks filled to 1800 psi and thus cannot operate with SCUBA quality gas. As seen in FIG. 17, regardless of safely handling high pressure, only a SCUBA fitting 28 can attach to a SCUBA tank (or canister) 126 and a $CO_2$ fitting 102 cannot. Use of SCUBA tanks with confetti projectors is believed to be unique and allows for much greater control for confetti projector operators. Specifically, confetti projector operators are capable and legally permitted to refill SCUBA tanks with SCUBA quality gas such as from air compressor generators. Use of $CO_2$ is classified as a Haz-mat (Hazardous material) by the department of transportation and can only be refilled at regulated refilling stations/organizations. Use of SCUBA quality gas is thus unique as it is less of a liability, environmentally friendly, and dramatically more user-friendly and requires unique necessary equipment in order to be utilized.

Figure 18:
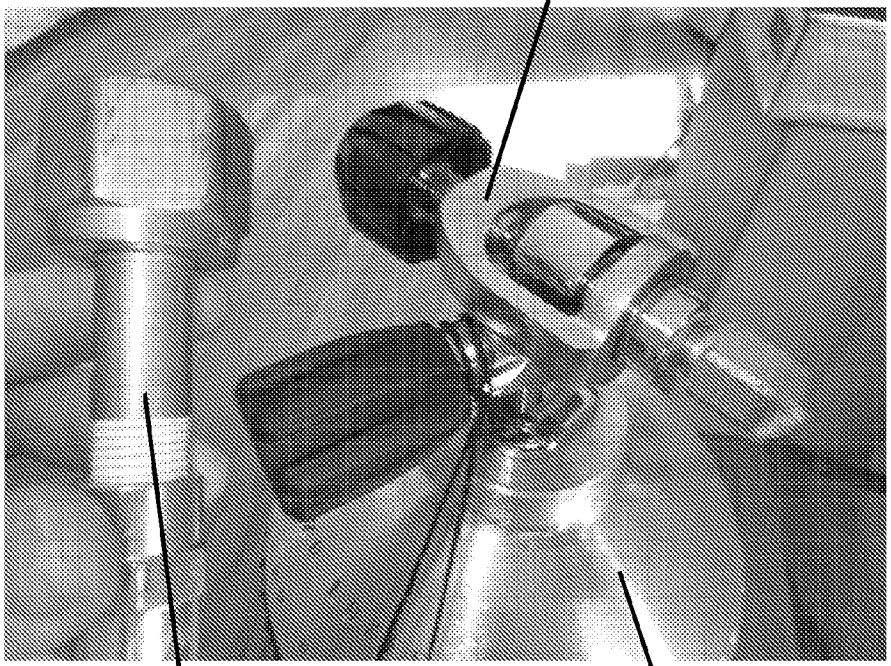
FIG. 18 is a top view showing the SCUBA fitting attached to a SCUBA gas canister and showing that the $CO_2$ fitting will not attach to the SCUBA gas canister.
Figure 20:
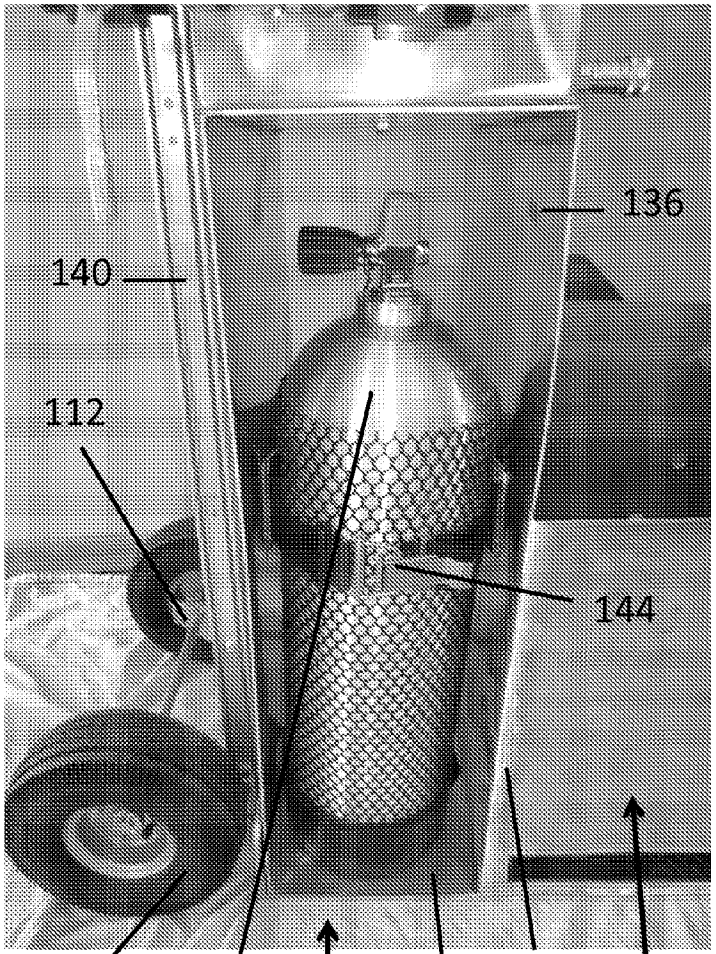
FIG. 20 is a side view of a confetti projector showing where the gas canisters may be supported within the storage space on a storage surface.
Figure 19:
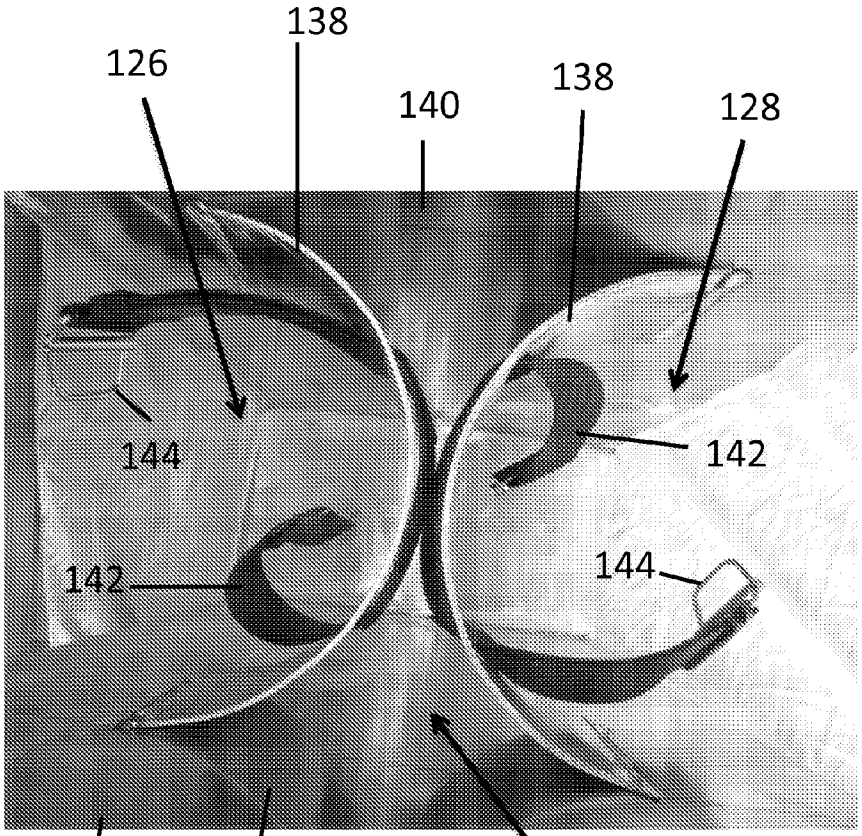
FIG. 19 is a top view of the storage space showing support plates and belt straps used to secure gas canisters to the housing.
Figure 22:
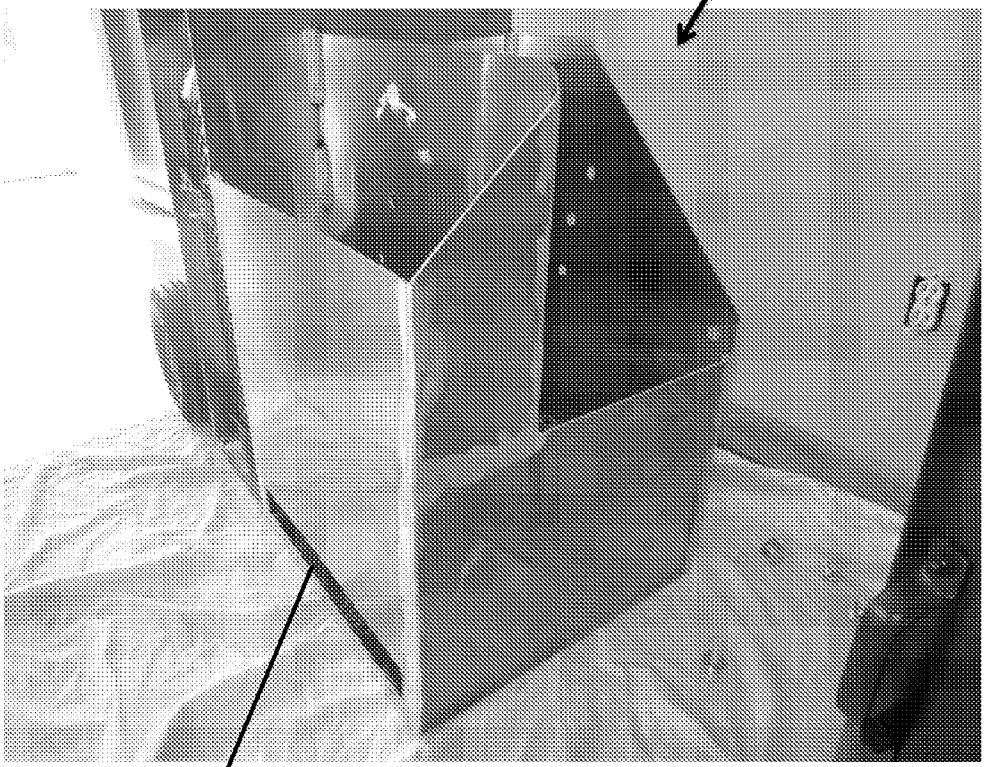
FIG. 22 is a side perspective view of the housing shown in FIG. 21.
Figure 21:
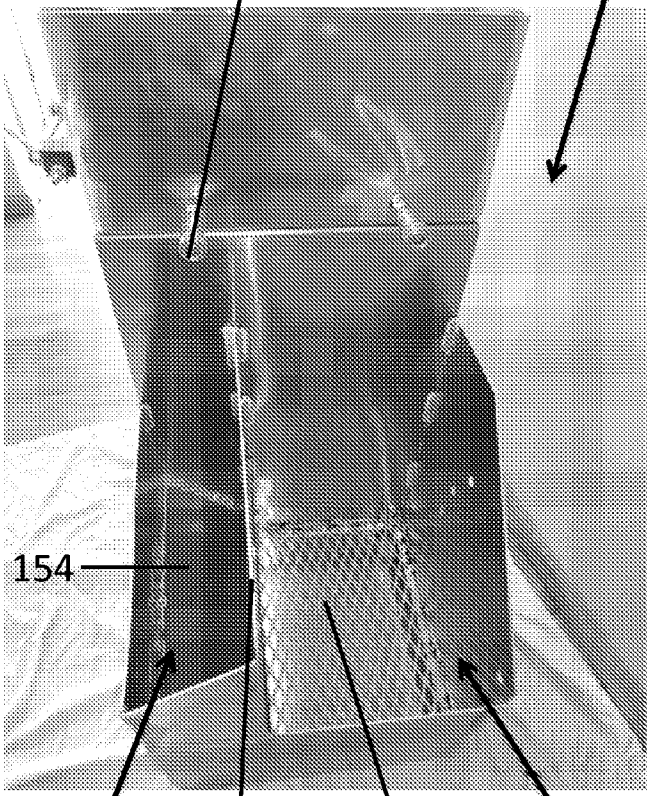
FIG. 21 is a top perspective view of the housing with the discharge tube and other components removed.

FIG. 18 is top view from inside the housing 114 showing first and second canister holding areas 126, 128—each of which sized and shaped to hold a gas canister 118—positioned within the storage space 134. To secure the gas canisters within the canister holding areas 126, 128, a support plate 138 may be attached between wall 136 and wall 140 within the storage space 134 and a pair of belt straps 142 may be tightened around the gas canisters to hold the gas canisters to the support plate 138. In one embodiment, shown in FIG. 19, a latch mechanism 144, comprising a pair of latch members, one on each matching belt strap 142, may be used to maintain the belt straps 142 around the gas canister 118 in a tightened condition and then unlatched when it is desired to remove or adjust the position of a gas canister. The support plates 138 may be curved, as shown, to match the outer surface of the juxtaposed gas canister. FIG. 20, like FIG. 12, illustrates the housing 114 attaching to a hand truck, which defines the support frame 112, having relatively larger wheels 146 making the confetti projector 100 extremely mobile; capable of climbing stairs "back stage" or quickly traversing surfaces of all kinds, all while transporting the SCUBA gas canisters at the same time FIG. 21 is a front view of the housing 114 from slightly above showing the first section 130 with the discharge tube and tube bracket removed. Similar to the housing 14, an inner wall 148 divides the first section 130 into a hopper 150, which receives confetti, and a discharge portion 152. The confetti falls onto an incline 154 that guides the confetti over and onto the floor 156, within the discharge portion 152, which may be grated, as shown, and thus thought of as a "false floor." The floor 156 may be positioned directly below where the discharge tube 116 would be placed thus creating the vacuum to lift and then launch the confetti. FIG. 22 is a front view of the housing 114, slightly from the side, showing the plenum inlet 158. For this embodiment, plenum inlet 158 is the only air inlet to the plenum. When actuated, the gas released from the gas canister creates a vacuum pulling air up through the false floor 156 from the plenum and from the plenum inlet 158. Having a plenum, and positioning it off to the side as shown, helps dramatically reduce the risk of launching foreign debris/substrate (such as gravel and sand) and other unwanted items along with, or instead of the confetti by mistake. The position of the plenum also increases confetti lift as the plenum "opens up" to the false floor 156 right after the incline of the hopper stops.

Figure 24:
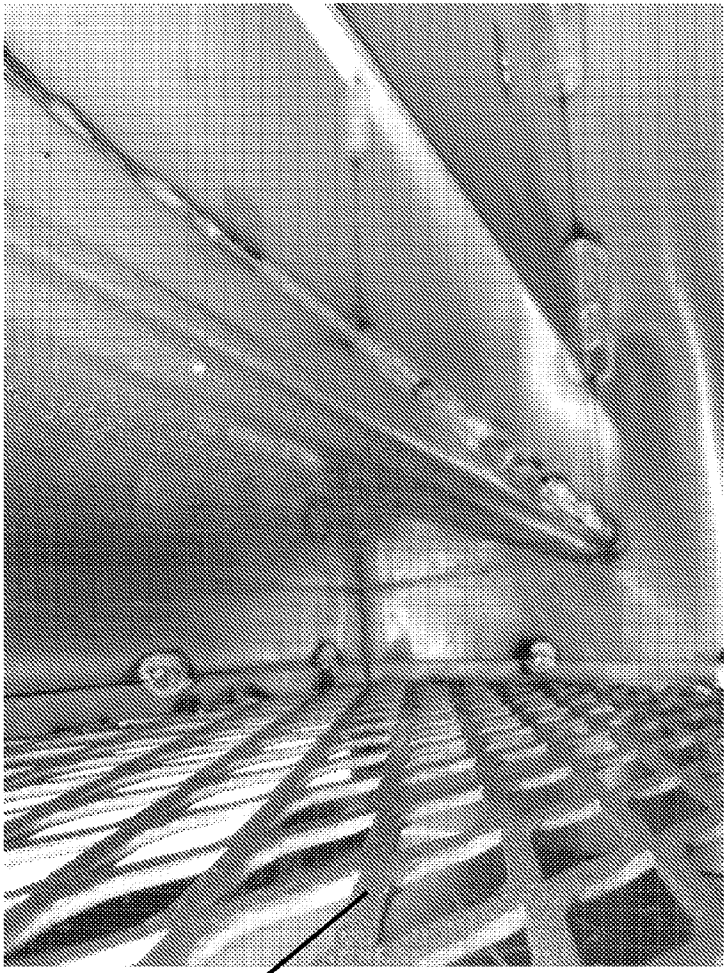
FIG. 24 is a perspective close-up view similar to that shown in FIG. 23 but from a different angle.
Figure 23:
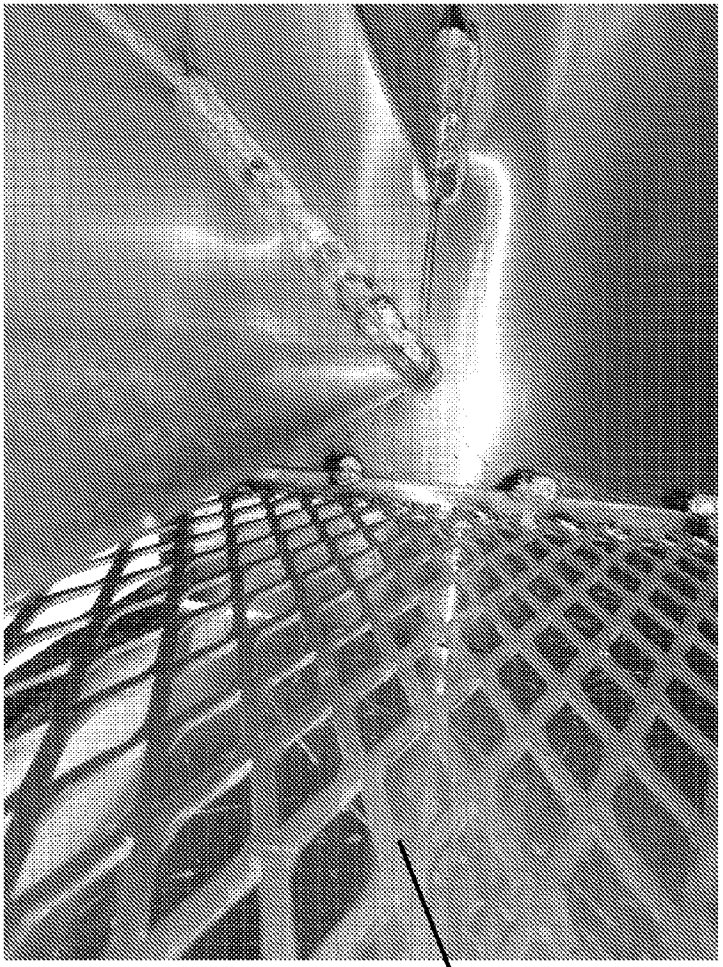
FIG. 23 is a perspective close-up view taken from inside the housing and showing the slant from the hopper walls.

FIG. 23 is a view taken from inside the housing 114 just below where the discharge tube 116 would be positioned. This view shows the slant from the hopper 150 walls where confetti may be dropped in and then directed to fall onto the false floor 156 directly beneath the discharge tube 116. A small portion of the plenum can also be seen through, and thus below, the false floor 156. A solid bottom below the false floor 156 acts as both structural support and a safety measure to reduce the risk of vacuuming up unwanted substrates (gravel, sand, etc.) during operation. FIG. 24 is another view inside the housing 114 facing the slant of the hopper and also showing a portion of the plenum below the false floor 156.

Figure 26:
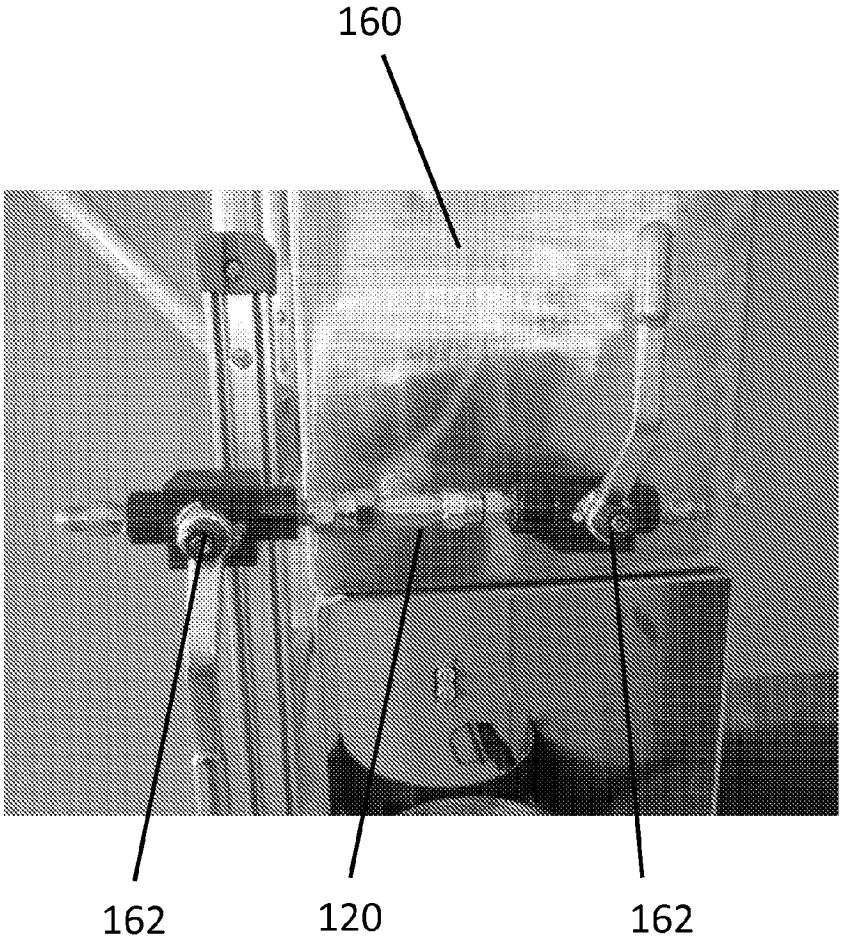
FIG. 26 is an external side view of the piping cabinet showing the manually operated ball valves.
Figure 25:
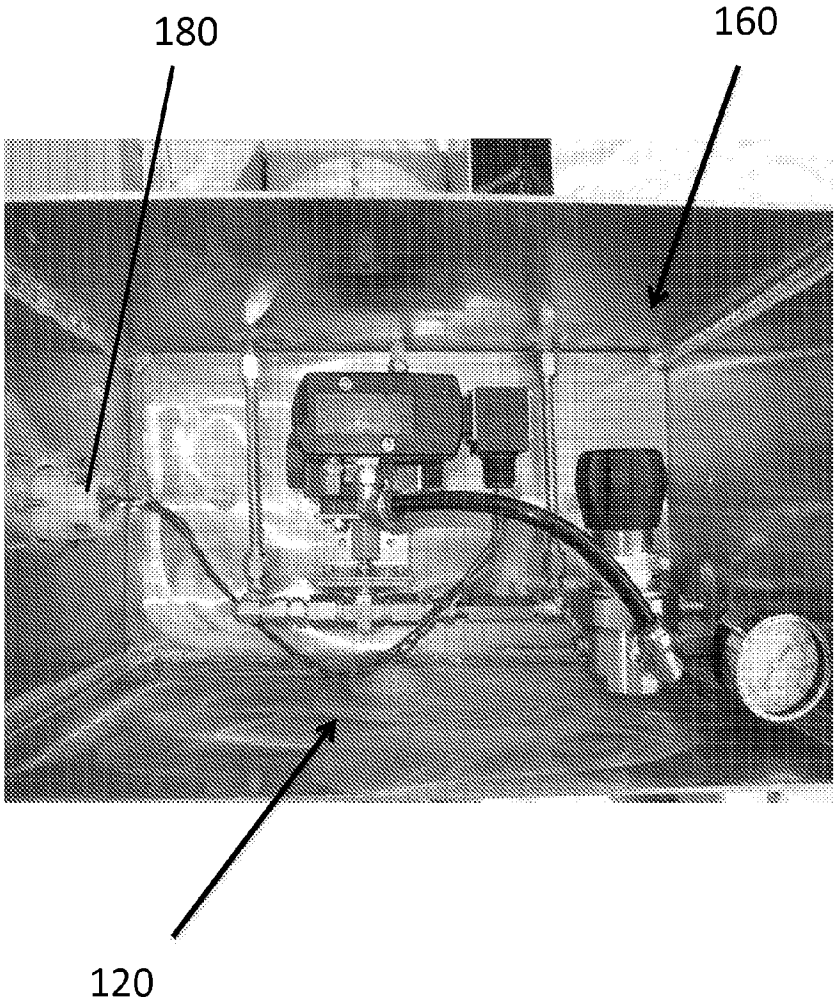
FIG. 25 is a top view looking down into the piping cabinet.

As shown in FIG. 12, a piping cabinet 160 may be supported to the housing 114 above the storage space 134. FIG. 25 is a close up top view looking down into the piping cabinet 160. The cabinet 160 may be detachable from the housing 114 for security in transporting the piping 120 components, which may be expensive and/or specialized, that are positioned within the piping cabinet 160. FIG. 26 is a side view of the piping cabinet 160 showing some of the piping 120 mounted external to the cabinet 160. (Externally mounted piping 120 is also visible in FIG. 12.) The particular externally mounted piping 120 shown, includes a pair of high pressure manual ball valves 164, 164 (each rated for 6000 psi) that 'T' together and then enter the cabinet 160. The ball valves 160, 160 may be positioned on the same side of the confetti projector 100 as the hopper 150. This arrangement is convenient for the operator so that adjusting the valves 162, 162, and inserting confetti can be accomplished from a central location. In FIG. 25, if visible, the ball valves 162, 162 would be on the right side of the cabinet 160 on the outside. The ball valves 162, 162 may be used to route the gas from one or more gas canisters (one such gas canister 118 is shown in FIGS. 12 and 20). If only one gas canister is needed (such as when a relatively shorter duration of confetti launching time is required) then the operator can use one of the valves 162 to operate the gas canister and can shut off the other valve 162. Gas traveling from the gas canister to the ball valves 162, 162 enters the valve system cabinet 160 (FIGS. 12, 25-30) which allows for both a manual and automatic operation of the confetti projector—given the specialized setup and high pressure rated equipment.

Figure 28:
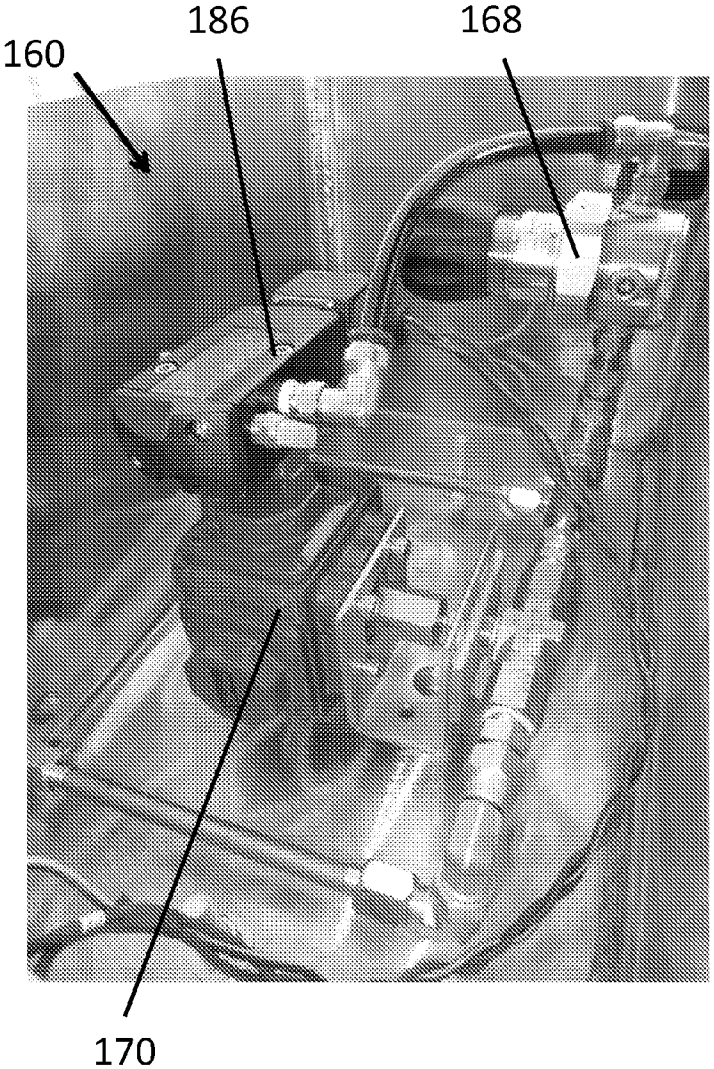
FIG. 28 is similar to FIG. 27 but from a different angle.
Figure 27:
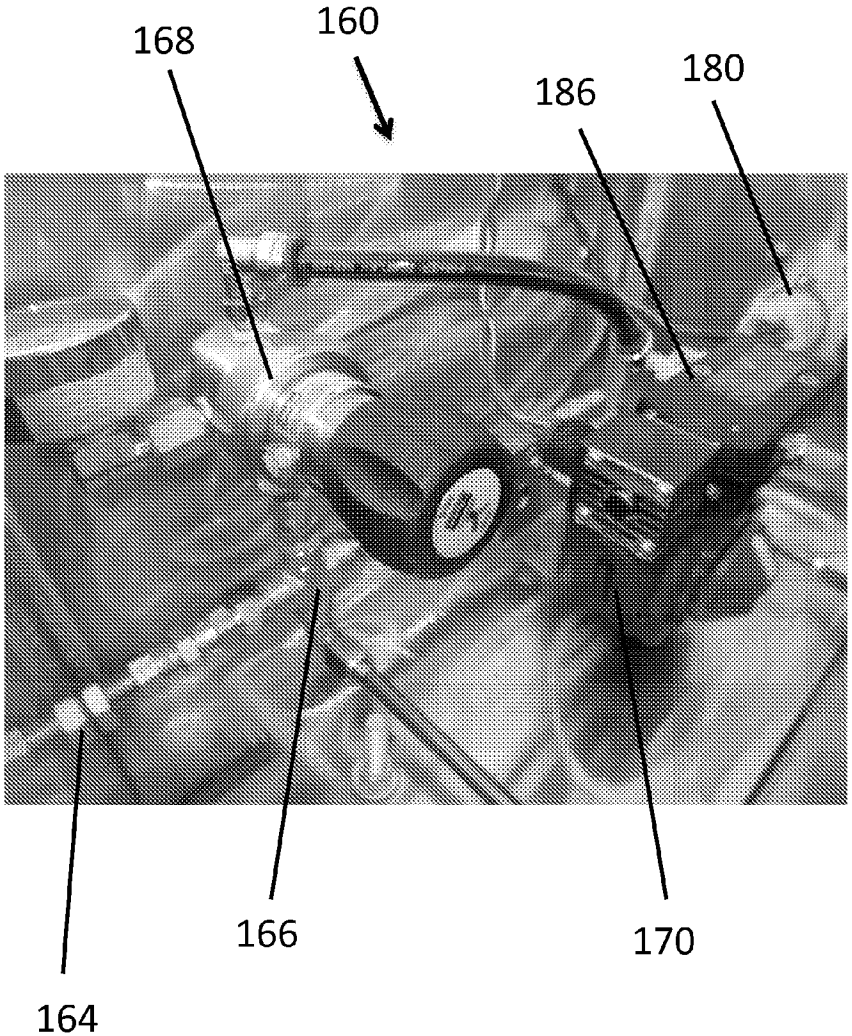
FIG. 27 is a side perspective view from within the piping cabinet

FIGS. 27 and 28 show the inside of the cabinet 160. FIG. 27 is a view looking from the front side. In the far left of the figure the main line/gas 164 is entering from the 'T' of the two ball valves 162, 162 meeting (FIG. 26). The main line 164 entering on the left in FIG. 26 then goes to a 3-way 'T' 166 where gas can go up to a pressure regulator 168 and then to a normally closed automatic ball valve 170 or down and to a line that ends with a high pressure quick disconnect fitting 172 (visible and labeled in FIG. 29) extending from the cabinet 160.

Figure 30:
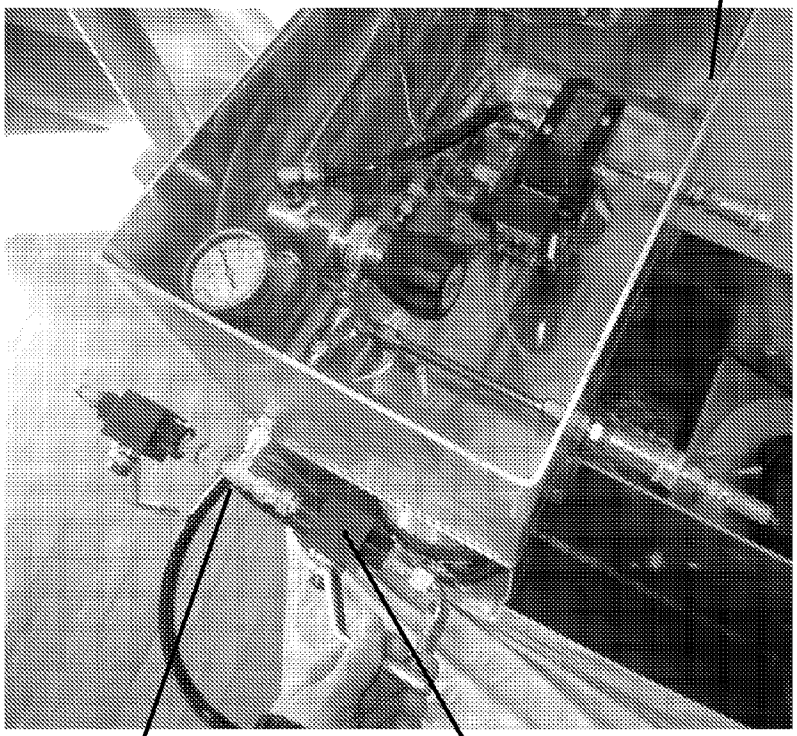
FIG. 30 is a top perspective view showing how one of the valves may be adjusted for manual operation of the confetti projector.
Figure 29:
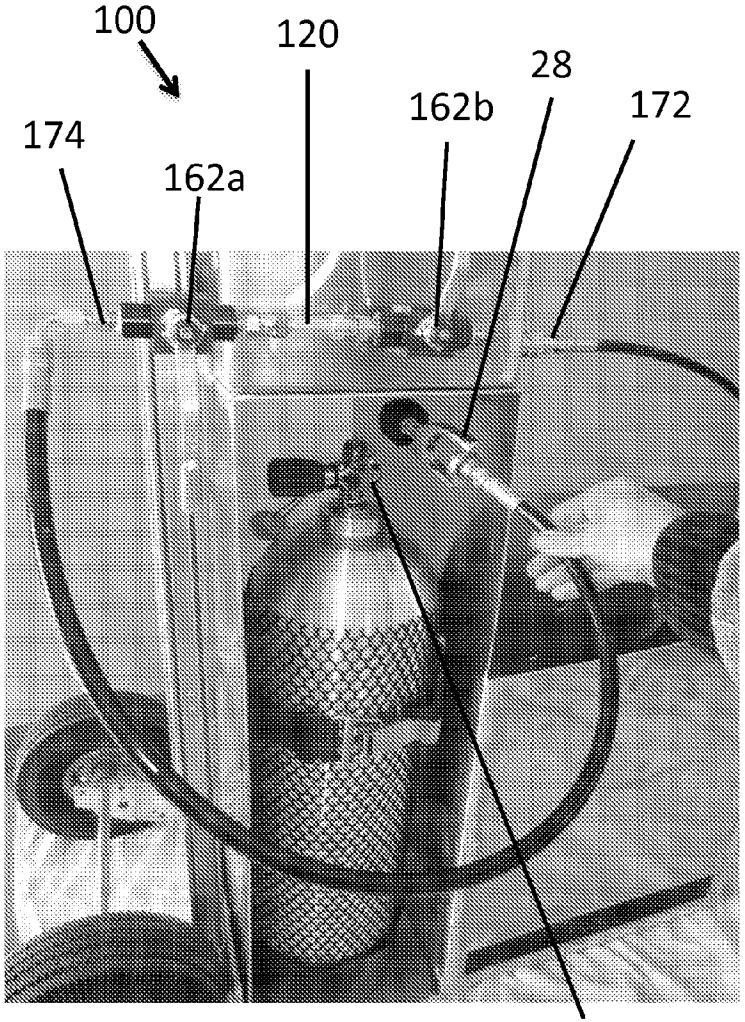
FIG. 29 is a side perspective view of a confetti projector showing how the tubing may be attached to the SCUBA gas canister.

FIG. 29 shows how an operator may attach the high pressure SCUBA fitting 28 to the top of the gas canisters 118. The gas canister 118 supplies gas to the piping 120 via the inlet fitting 174. When operated, the gas exits the cabinet 160, via the quick disconnect 172, and proceeds to the discharge tube 116. Valve 162*a* serves as an "on/off" valve. It has to be opened to permit the confetti projector 100 to operate. FIG. 30 shows that when the line connecting to the discharge tube 116 is connected into the first quick-release on the outside of the cabinet 160, the automatic system is bypassed. Shown is manual-mode operation which will be actuated when the operator turns the manual ball valve 162*b* open. This sends the gas directly to the discharge tube 116 to initiate vacuum and thus launching of the confetti. When the hose is connected into the other quick-release fitting on the outside of the housing the confetti projector 100 is ready for automatic mode. The gas will not escape the quick disconnect fittings that are not connected to a hose, thus creating a 'two-in-one' capability for operation mode.

Figure 31:
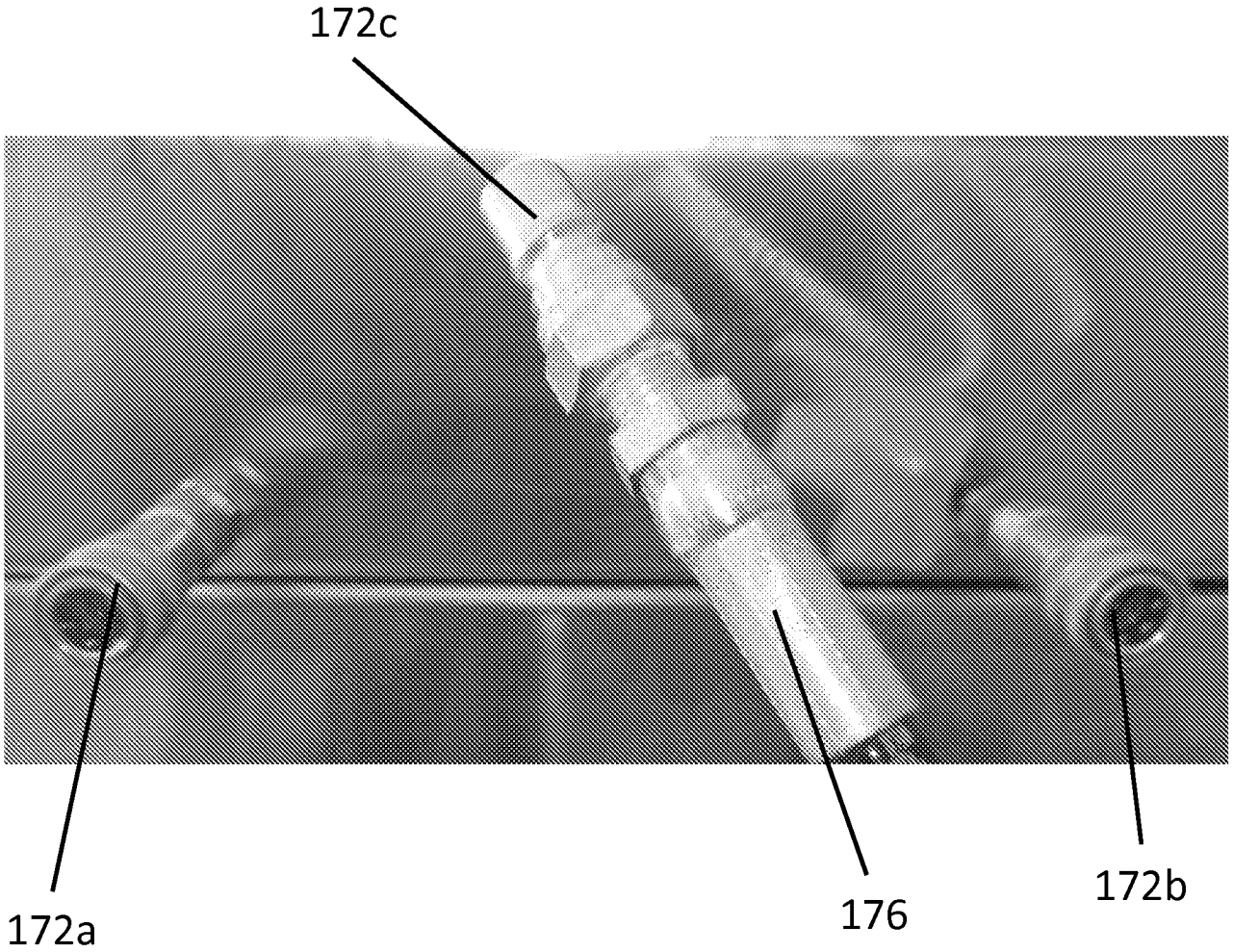
FIG. 31 is a side view showing a pair of quick disconnect fittings.
Figure 33:
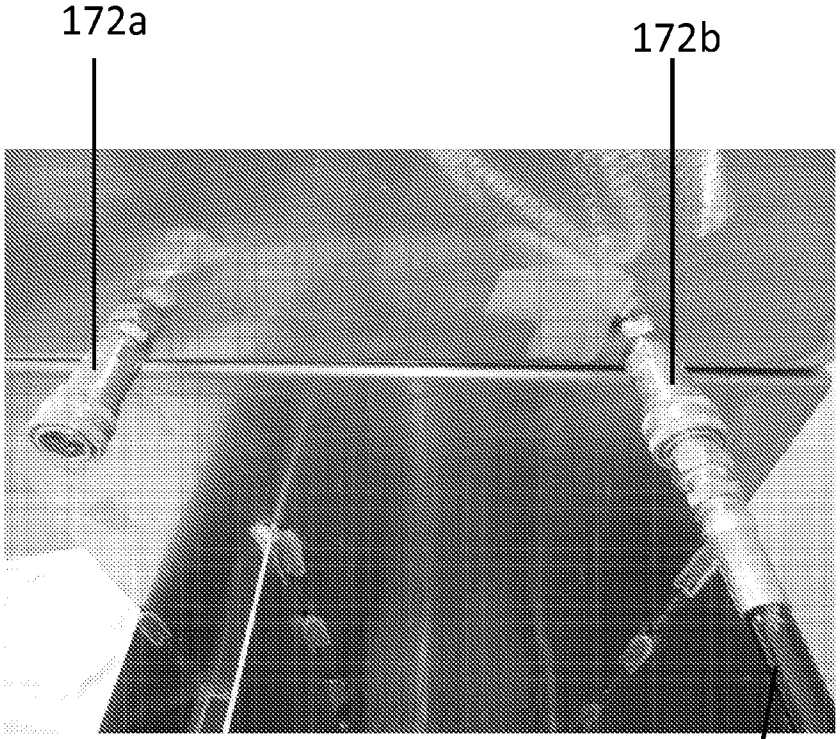
FIG. 33 is a side perspective view showing a hose connected to the quick disconnect fitting used for automatic operation of the confetti projector.
Figure 32:
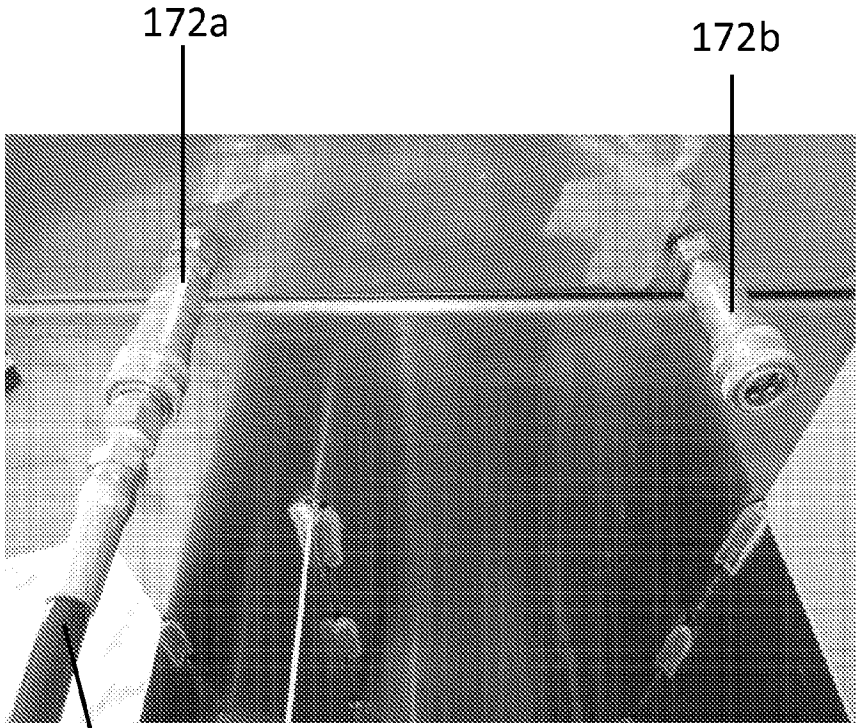
FIG. 32 is a side perspective view showing a hose connected to the quick disconnect fitting used for manual operation of the confetti projector.

FIG. 31 shows the manual quick-disconnect (quick-release) port 172*a* on the left outside the cabinet and the automatic quick-disconnect (quick-release) port 172*b* on the right. The hose 176 in the middle has a quick-disconnect fitting 172*c* for connection into either port on one end, while the other end connects to the discharge tube 116 or 16. FIG. 32 shows the quick-release port 172*a*, the manual port, connected to the hose 176 and FIG. 33 shows the quick-release port 172*b*, the automatic port, connected to the hose 176.

Figure 35:
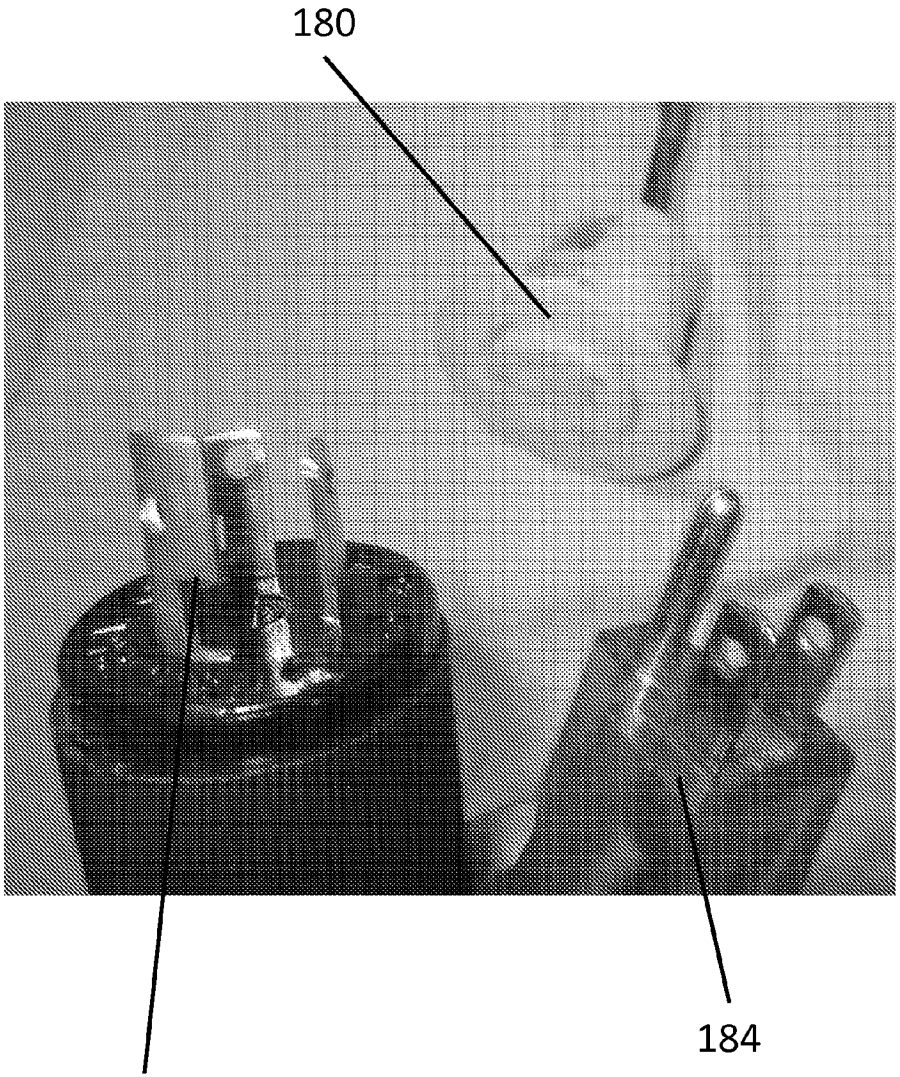
FIG. 35 is a close-up view showing a female electrical receptacle, a male twist-lock plug and a standard male plug.
Figure 34:
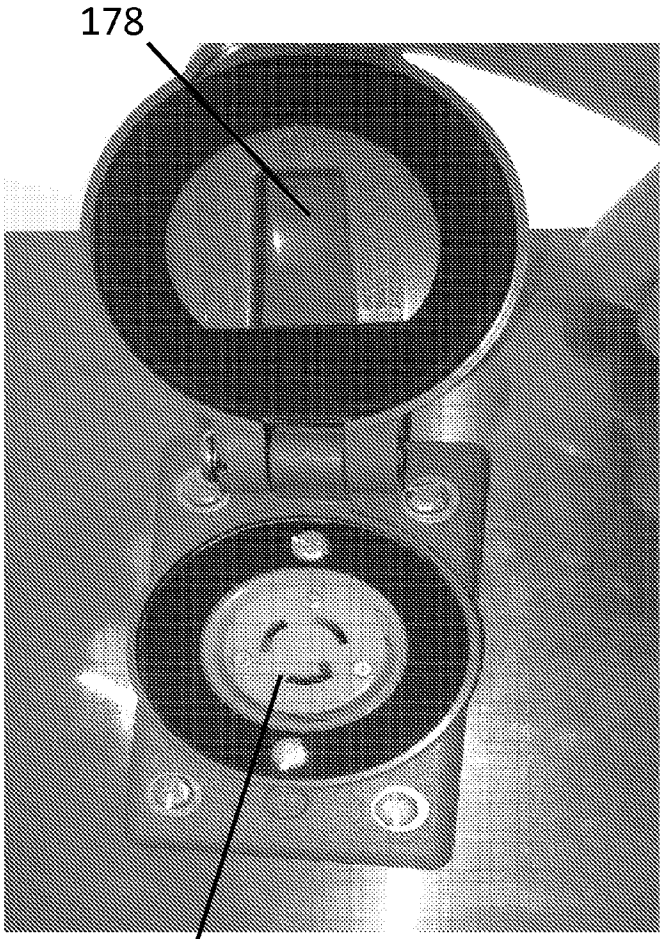
FIG. 34 is a close-up view showing a female electrical receptacle.

FIG. 34 shows the outside of the cabinet on the opposite side of the manual ball valves and shows the all-weather covering 178 for a twist-lock female electrical receptacle 180 mounted on the opposite side of the cabinet shown in FIG. 26. The receptacle 180 is also referenced in FIGS. 25, 27 and 35. Use of the female twist-lock receptacle 180 creates an operation safety step for automatic mode. A unique cable may be used to connect the confetti projector 100 to standard electrical outlets, extension cables, girds, etc. to operate in automatic mode. FIG. 35 shows a male twist-lock plug 182 that connects with the female twist-lock receptacle 180. The connection of the male twist-lock plug 182 with the female twist-lock receptacle 180 provides a secure connection preventing accidental unplugging before or during automatic use. The other end of this unique cable has another male plug 184 that may be a standard 3-prong plug capable of connecting with standard outlets, cables, etc. This type of connections/cables prevents accidental plugging in back stage/etc. (and in turn actuation of the confetti projector 100) by any non-cannon operators by means of ignorant mistake or malice.

With reference to FIG. 12, during the automatic mode gas from the canisters 118 moves through the open ball valves 162 outside the cabinet 160. The gas then moves, as shown in FIGS. 27 and 28, through main line 164 and fills lines up to the closed automatic ball valve 170. It also fills, as shown in FIGS. 31-33, the line to quick-release 172*a* of manual port that maintains a closed seal when not connected to a hose and, as shown in FIGS. 27-28, the line to the regulator 168. The regulator 168 may be capable of an extremely wide range of psi, regulating pressure down from, in one embodiment, 4000 psi to 0. This range is safely in range for use of SCUBA pressure entering at about 3300 psi. The regulator 68 is used, in one embodiment, to reduce the gas pressure down to anywhere from 30 psi to 150 psi for the electronically actuated valve 186. When electrical actuation is sent to the valve 186 by means of switch or simply plugging into an outlet, the valve 186 uses the electricity to then use a small amount/low psi of the main gas supply (30-150 operating psi range) to then turn the automatic ball valve 170 to the open position thus releasing the rest of the gas through the automatic quick-release port 172*b* and through the hose that connects to the discharge tube 116. The main ball valve 170 may be spring returned to the closed position when electricity is cut off or the gas canister(s) 118 purges to below the minimum pressure requirement, 30 psi for example, required for the electronically actuated valve 186 to keep the valve 170 in the open position.

The materials used to make the various components of the confetti projectors 10 and 100 can be any chosen with the sound judgment of a person of skill in the art. The support frames 12, 112, housings 14, 114 and discharge tubes 16, 116 may be formed, in one embodiment, of steel. It is also contemplated to use a single control system to simultaneously control multiple confetti projectors. The control system, whether for just one or multiple confetti projectors, can include timers to better control the precise timing of confetti discharge.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A confetti projector comprising:

a support frame comprising a base and a support structure extending vertically upward from the base, wherein the base comprises a bottom surface, a first side wall that extends generally upward from the bottom surface, a second side wall that extends generally upward from the bottom surface opposite to the first side wall and a back wall extending upward from the bottom surface, wherein the base further comprises a housing bracket;

a plurality of wheels attached to the support frame by an axle;

a housing that is supported to the housing bracket on the support frame which allows the housing to be supported above the bottom surface of the base, wherein the housing comprises four outer walls and an inner wall that divides the housing into a hopper and a discharge portion, wherein the housing further comprises an opening, wherein the hopper communicates with the discharge portion and the opening communicates with the discharge portion;

wherein the base of the support frame, with the housing positioned on the housing bracket, defines a plenum which allows ambient air to move horizontally along a bottom surface and then vertically into the opening of the housing;

wherein at least one of the support frame and the housing comprises a storage surface;

a first discharge tube that is supported to the housing and communicates with the discharge portion of the housing;

a first gas canister that is supported on the storage surface;

piping that comprises a first valve and that communicates compressed air from the first gas canister to one of the housing and the first discharge tube;

wherein the confetti projector is operable by opening the first valve a desired degree to permit gas to exit the first gas canister and enter the first discharge tube to draw a vacuum in the first discharge tube to cause associated ambient air to travel into the opening in the housing and then through the discharge portion to cause associated confetti within the hopper to exit the first discharge tube; and, wherein the confetti projector is transportable on the plurality of wheels to simultaneously transport the support frame, the housing, the first discharge tube, the first gas canister and the piping.

2. The confetti projector of claim 1 further comprising:

a second gas canister that is supported on the storage surface; and, wherein the confetti projector is transportable on the plurality of wheels to also simultaneously transport the second gas canister.

3. The confetti projector of claim 1 wherein:

the support frame comprises a handle;

the plurality of wheels includes only two wheels; and, the confetti projector is transportable on the two wheels by an associated operator holding only the handle.

4. The confetti projector of claim 3 wherein each of the two wheels has an outside diameter of at least 5 inches.

5. The confetti projector of claim 1 wherein the base of the support frame comprises:

a bottom surface defining the storage surface;

a front portion comprising a front opening;

a back portion comprising a back opening;

wherein the bottom surface, the first side wall, and the second side wall further defines the plenum that forces the associated ambient air to travel into the front and back openings, then substantially horizontally along the bottom surface of the support frame, then substantially upwardly into the opening in the housing.

6. The confetti projector of claim 1 wherein the support frame comprises:

a base comprising a bottom surface defining the storage surface; and a handle mounted to the support structure, wherein the handle is positioned at least 3.5 feet above an associated flat ground surface when the plurality of wheels support the confetti projector on the associated flat ground surface.

7. The confetti projector of claim 1 wherein the housing is mountable to the support frame in a right hand orientation and in a left hand orientation.

8. The confetti projector of claim 1 wherein:

the first discharge tube has a size;

the confetti projector further comprises: a second discharge tube having a size that is significantly different than the size of the first discharge tube; and, an adapter plate that enables at least one of the first and second discharge tubes to be supported to the housing;

the confetti projector is adjustable from: (1) a first condition where the first discharge tube is supported to the housing and communicates with the discharge portion of the hopper and the second discharge tube does not communicate with the discharge portion of the hopper; to, (2) a second condition where the second discharge tube is supported to the housing and communicates with the discharge portion of the hopper and the first discharge tube does not communicate with the discharge portion of the hopper;

the adapter plate is one of but not both of: (1) attached between the first discharge tube and the housing when the confetti projector is in the first condition; and, (2) attached between the second discharge tube and the housing when the confetti projector is in the second condition; and, wherein the confetti projector is operable when in the second condition by opening the first valve a desired degree to permit gas to exit the first gas canister and enter the second discharge tube to draw a vacuum in the second discharge tube to cause associated ambient air to travel into the opening in the housing and then through the discharge portion to cause associated confetti within the hopper to exit the second discharge tube.

9. The confetti projector of claim 1 wherein:

the piping has a use rating of at least 4000 PSI;

the first valve has a use rating of at least 4000 PSI; and, the gas is a SCUBA quality gas of compressed air having a stored pressure of around 4000 PSI.

10. The confetti projector of claim 1 further comprising:

a support plate;

a belt strap; and, wherein the belt strap is tightenable around the first gas canister to secure the first gas canister against the support plate while the first gas canister is supported on the storage surface.

11. The confetti projector of claim 1 wherein:

the first valve is manually adjustable between open and closed conditions;

the piping further comprises a second valve that is automatically adjustable with an electric signal between open and closed conditions, wherein the electrical signal sent to the valve by means of a switch allowing the passage of electricity from an outlet to the second valve;

the confetti projector is operable by manually opening the first valve a desired degree to permit gas to exit the first gas canister and enter the first discharge tube to draw a vacuum in the first discharge tube to cause associated ambient air to travel into the opening in the housing and then through the discharge portion to cause associated confetti within the hopper to exit the first discharge tube; and, the confetti projector is operable by automatically opening the second valve a desired degree to permit gas to exit the first gas canister and enter the first discharge tube to draw a vacuum in the first discharge tube to cause associated ambient air to travel into the opening in the housing and then through the discharge portion to cause associated confetti within the hopper to exit the first discharge tube.

12. A confetti projector comprising:

a support frame comprising a base and a support structure extending vertically upward from the base, wherein the base comprises a bottom surface, a first side wall that extends generally upward from the bottom surface, a second side wall that extends generally upward from the bottom surface opposite to the first side wall and a back wall extending upward from the bottom surface, wherein the base further comprises a housing bracket;

a housing that is supported to the housing bracket on the support frame which allows the housing to be supported above the bottom surface of the base, wherein the housing comprises four outer walls and an inner wall that divides the housing into a hopper and a discharge portion, wherein the housing further comprises an opening, wherein the hopper communicates with the discharge portion and the opening communicates with the discharge portion;

wherein the base of the support frame, with the housing positioned on the housing bracket, defines a plenum which allows ambient air to move horizontally along a bottom surface and then vertically into the opening of the housing;

a first discharge tube that is supported to the housing and communicates with the discharge portion of the hopper;

a gas canister that contains SCUBA quality gas of compressed air having a stored pressure of around 4000 PSI;

piping that comprises a valve and that communicates compressed air from the gas canister to one of the housing and the discharge tube, wherein all the piping has a use rating of at least 4000 PSI; and, wherein the confetti projector is operable by opening the valve a desired degree to permit the SCUBA quality gas of compressed air to exit the gas canister and enter the first discharge tube to draw a vacuum in the first discharge tube to cause associated ambient air to travel into the opening and then through the discharge portion to cause associated confetti within the hopper to exit the first discharge tube.

13. The confetti projector of claim 12 wherein:

the first discharge tube has a size;

the confetti projector further comprises: a second discharge tube having a size that is significantly different than the size of the first discharge tube; and, an adapter plate that enables at least one of the first and second discharge tubes to be supported to the housing;

the confetti projector is adjustable from: (1) a first condition where the first discharge tube is supported to the housing and communicates with the discharge portion of the hopper and the second discharge tube does not communicate with the discharge portion of the hopper; to, (2) a second condition where the second discharge tube is supported to the housing and communicates with the discharge portion of the hopper and the first discharge tube does not communicate with the discharge portion of the hopper;

the adapter plate is one of but not both of: (1) attached between the first discharge tube and the housing when the confetti projector is in the first condition; and, (2) attached between the second discharge tube and the housing when the confetti projector is in the second condition; and, wherein the confetti projector is operable when in the second condition by opening the valve a desired degree to permit gas to exit the gas canister and enter the second discharge tube to draw a vacuum in the second discharge tube to cause associated ambient air to travel into the opening in the housing and then through the discharge portion to cause associated confetti within the hopper to exit the second discharge tube.

* * * * *